US006261746B1

(12) United States Patent
Kosugi

(10) Patent No.: US 6,261,746 B1
(45) Date of Patent: Jul. 17, 2001

(54) IMAGE-FORMING METHOD

(75) Inventor: Takuji Kosugi, Kanagawa (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 09/487,326

(22) Filed: Jan. 19, 2000

(30) Foreign Application Priority Data

Jan. 20, 1999 (JP) ..... 11-012012

(51) Int. Cl.[7] ..... G03C 5/00; G03C 7/26

(52) U.S. Cl. ..... 430/363; 430/203; 430/351; 430/503; 430/604

(58) Field of Search ..... 430/505, 203, 430/604, 351, 363, 503

(56) References Cited

U.S. PATENT DOCUMENTS 5,739,896 * 4/1998 Patton et al. ..... 355/27
6,017,684 * 1/2000 Miyake ..... 430/351

FOREIGN PATENT DOCUMENTS 10-161262 6/1998 (JP) .
10-161263 6/1998 (JP) .

* cited by examiner

*Primary Examiner*—Thorl Chea
(74) *Attorney, Agent, or Firm*—Burns, Doane, Swecker & Mathis, LLP

(57) ABSTRACT

Disclosed is an image-forming method which comprises exposing a photographic material comprising a support having thereon at least a photosensitive silver halide emulsion and a binder, the silver halide emulsion containing at least one compound selected from metal ions and metal complex ions which are electron traps of 0.2 eV or less in depth, with an exposing head having at least three kinds of exposure light sources having different specific light emitting wavelength regions corresponding to at least three different color sensitivities of the photographic material, each of the at least three kinds of exposure light sources having different center-of-gravity wavelengths in each of the specific light emitting wavelength regions, wherein each of the specific light emitting wavelength regions is from the shortest wavelength to the longest wavelength among the exposure light sources having different center-of-gravity wavelengths, and the photographic material has a sensitivity variation of 0.01 logE/nm or less in each of the specific wavelength light emitting wavelength regions.

5 Claims, No Drawings

IMAGE-FORMING METHOD

FIELD OF THE INVENTION

The present invention relates to an image-forming method and particularly to a method of forming an image by exposing a heat-developable photographic material with a plurality of exposure light sources.

BACKGROUND OF THE INVENTION

Heat-developable photographic materials are well-known and heat-developable photographic materials and processes for using such photographic materials are described, for example, in *Shashin Kogaku no Kiso, Hi-Gin-En Shashin-Hen* (*The Elementary Course of Photographic Engineering, Section of Nonsilver Photography*), pp. 242 to 255, Corona Publishing Co. (1982), and U.S. Pat. No. 4,500,626, etc.

In addition, a method for forming a color image by the coupling reaction of the oxidation product of a developing agent with a coupler is disclosed in U.S. Pat. Nos. 3,761,270 and 4,021,240. A method for forming a positive color image by a photosensitive silver dye bleach process is disclosed in U.S. Pat. No. 4,235,957.

Further, a method of imagewise releasing or forming diffusible dyes by heat development and transferring these diffusible dyes to a dye fixing element has been proposed. In this method, both a negative dye image and a positive dye image can be obtained by changing the kind of a dye-providing compound and the kind of silver halide to be used. Further details are disclosed in U.S. Pat. Nos. 4,500,626, 4,483,914, 4,503,137, 4,559,290, JP-A-58-149046, JP-A-60-133449, JP-A-59-218443, JP-A-61-238056 (the term "JP-A" as used herein means an "unexamined published Japanese patent application")), EP-A-220746, Kokai Giho (JIII Journal of Technical Disclosure) No. 87-6199, EP-A-210660, etc.

Various methods have been proposed as to methods of obtaining positive color images by heat development. For example, a method in which a so-called DRR compound (a dye releasing redox compound) is converted to a compound of an oxidized form having no dye-releasing capability, and the compound, in the presence of a reducing agent or a precursor thereof, is heat developed, the reducing agent is oxidized corresponding to the exposure amount of silver halide by heat development, and the compound is reduced by the remaining reducing agent not oxidized to release a diffusible dye is disclosed in U.S. Pat. No. 4,559,290. Further, a heat-developable color photographic material using, as a compound which releases a diffusible dye by the same mechanism, a compound which releases a diffusible dye by the reductive cleavage of an N—X bond (wherein X represents an oxygen atom, a nitrogen atom or a sulfur atom) is disclosed in EP-A-220746 and Kokai Giho No. 87-6199 (No. 22, Vol. 12).

Heat-developable color photographic can be developed with a compact developing machine because development processing can be performed simply and rapidly as compared with ordinary wet developing photographic materials. Therefore, comparatively inexpensive color copiers and color printers of a system of silver salt color photographic material have been developed and now on the market. It has been thought that various improvements are necessary for further widening the use for these machines. Many kinds of exposure light sources are proposed for such a photographic material. For example, as a digital exposure light source, a light emitting diode (LED), a semiconductor laser (LD) and a variety of fluorescent substances are used at present.

Various plans have been devised hitherto, for example, with respect to inexpensive LED and LD, a plurality of elements are arranged in a row to perform scanning exposure to shorten exposure time. However, in such a method of using a plurality of elements, there arises a problem that density unevenness of an image occurs due to the scatter among elements. Further, the wavelengths of LED and LD fluctuate due to the heat generated by LED and LD themselves during use and the temperature variation by the heat generated from other parts of an exposure unit, and the density unevenness of an image also occurs by the variation of light wavelength. The variation of light wavelength occurs particularly conspicuously in inexpensive LED although it also occurs in LD.

When a plurality of light sources are used, the present inventors devised a means of measuring the individual light amount and wavelength in regard to the density change due to the nonuniformities of the light emitting wavelength and the light amount of the light source, and previously compensating them to become a uniform result. However, the density unevenness could not be improved sufficiently contrary to expectations. This was due to the fact that in the spectral sensitivity region wherein the sensitivity change to the wavelength was sudden, there were errors in the measurement of wavelength, hence compensation was insufficient. It is possible to select the same wavelength in advance, but this means is extremely low yielding and economically disadvantageous.

Further, the present inventors tried to perform sufficient temperature control to the wavelength fluctuation during use, but it was found that suppressing the wavelength fluctuation was difficult as LED and LD themselves generated heat and, in particular, the temperature had fallen before use of these units at rise time.

Moreover, when a plurality of light sources are used for exposure, exposure is performed with a plurality of light sources scanning at the same time as one block. In that case an individual light emitting element in one block is exposed simultaneously (without a time lag), but a gap between one block and the next block is to be exposed with taking time by the time of scanning. In the case where the difference is generated in sensitivity between the time when exposure is carried out without a time lag and the time when exposure is carried out with a time lag, the doubled (overlapped) part between blocks is to be seen differently from the double (overlap) of beams in one block. Although little as difference in density of an image, this exposure streak unevenness is easily observed visually, therefore, this is the item to which care must be taken when a plurality of light sources are used for exposure.

For shortening the entire imaging time, scanning exposure not only in one direction but on the way back, i.e., reciprocating writing, is conducted in many cases. In such a case, the exposure interval time at the doubled (overlapped) part between one block and the next block is not constant and the exposure interval time at the first double (overlap) and the last double (overlap) is varied, as a result exposure streak unevenness is more easily observed visually. This is required to be improved as reciprocating writing unevenness among the above exposure streak unevenness.

SUMMARY OF THE INVENTION

Accordingly, an object of the present invention is to improve the exposure density unevenness, in particular, reciprocating writing unevenness, which is generated by exposure using a plurality of exposure light sources.

(1) An image-forming method which comprises exposing a photographic material comprising a support having thereon at least a photosensitive silver halide emulsion and a binder, the silver halide emulsion contains at least one compound selected from metal ions and metal complex ions which are electron traps of 0.2 eV or less in depth, with an exposing head having at least three kinds of a plurality of exposure light sources having different specific light emitting wavelength regions corresponding to at least three different color sensitivities of the photographic material, each of the at least three kinds of exposure light sources having different center-of-gravity wavelengths in each of the specific light emitting wavelength regions, wherein each of the specific light emitting wavelength regions is from the shortest wavelength to the longest wavelength among the exposure light sources having different center-of-gravity wavelengths, and the photographic material has a sensitivity variation of 0.01 logE/nm or less in each of the specific wavelength light emitting wavelength regions.

(2) The image-forming method as in the above item (1), wherein the silver halide emulsion contains at least one compound selected from metal ions and metal complex ions which are electron traps of 0.2 eV or less in depth, and at least one compound selected from metal ions and metal complex ions which are electron traps of 0.35 eV or more in depth.

(3) The image-forming method as in the above item (1) or (2), wherein the photographic material is a heat-developable photographic material comprising a support having thereon at least three silver halide emulsions each having different color sensitivity, a binder, and a dye-providing compound.

(4) The image-forming method as in the above item (1), (2) or (3), wherein the at least three kinds of exposure light sources are LEDs having light emitting wavelengths of from visible region to infrared region.

(5) The image-forming method as in the above item (1), (2), (3) or (4), wherein the at least three kinds of exposure light sources are blue LEDs, green LEDs and red LEDs.

(6) The image-forming method as in any one of the above items (1) to (5), wherein the exposing head having a plurality of exposure light sources performs reciprocating writing which is scanning exposure not only in one direction but on the way back.

DETAILED DESCRIPTION OF THE INVENTION

The exposing method according to the present invention can use a method comprising scanning exposing image data through an electric signal by emitting a light emitting diode, various kinds of lasers (e.g., a laser diode, a gas laser, etc.) (methods disclosed in JP-A-2-129625, JP-A-5-176144, JP-A-5-199372, JP-A-6-127021, etc.).

As the image data, image data obtained from a video camera and an electron still camera, television signals represented by Nippon Television Signal Code (NTSC), image signals obtained by dividing the original to many pixels by scanning, and image signals represented by CG and CAD formed by a computer can be used in the present invention.

The exposure light sources of the present invention are particularly effective when LEDs, which are inexpensive, are used. In general, three kinds of LEDs having light emitting wavelength regions corresponding to at least three spectral sensitivities each having different color sensitivity are used to a color photographic material. The light emitting wavelength regions each is from visible region to infrared region, and is not particularly limited. Three kinds of light sources selected from among blue, green, red and infrared are generally used. Light sources of blue LEDs, green LEDs and red LEDs are used in the case corresponding to the spectral sensitivity of ordinary color paper.

In the region of the shortest wavelength to the longest wavelength of the plurality of light sources for use in the present invention, blue LED of ±10 nm, preferably ±5 nm, of specific wavelength selected from among 430 to 480 nm, green LED of ±10 nm, preferably ±5 nm, of specific wavelength selected from among 500 to 560 nm, and red LED of ±10 nm, preferably ±5 nm, of specific wavelength selected from among 640 to 690 nm can be used. The average value of peak wavelengths of the plurality of light sources for use in the present invention is defined as the wavelength of center of gravity.

When image data is scanning exposed through an electric signal, it is not necessary to adhere to blue, green and red in the above visible region, and these can be used in arbitrary combination including light sources such as infrared.

When the plurality of light sources according to the present invention are used, light sources of preferably from 2 to 400, particularly preferably from 5 to 100, are used to each luminescent color (illumination color) in an exposure unit of A4 size (21 cm×29.7 cm). It is possible to measure the light amount and wavelength of each light source and to be compensated for in advance before use.

The photographic material for use in the present invention fundamentally comprises a support having thereon a photosensitive silver halide emulsion, a binder, and a dye-providing compound (in some cases a reducing agent serves both as described later). An organic metallic salt oxidizing agent may further be contained, if necessary. These components are added to the same layer in many cases, but they can be contained in other layers separately in a state capable of reaction. For instance, when a colored dye-providing compound is present in the lower layer of the silver halide emulsion, it prevents the reduction of sensitivity. It is preferred to incorporate a reducing agent into a photosensitive element, but it may be supplied from the outside by means of, e.g., diffusion from a dye fixing element described later.

For obtaining a wide range of colors on the chromaticity diagram using three primary colors of yellow, magenta and cyan, at least three silver halide emulsion layers each having light sensitivity in a different spectral region are used in combination. The layer constitution of the present invention comprises at least a green-sensitive layer and two other silver halide emulsion layers each having light sensitivity in a different spectral region, generally takes the structure of the combination of three layers of a blue-sensitive layer and a red-sensitive layer in addition. Each sensitive layer may take various orders of arrangement known in ordinary color photographic materials. Further, each of these photosensitive layers may be divided into two or more layers, if necessary.

In general, a silver halide emulsion spectrally sensitized in the region of the wavelength of from 400 to 500 nm (a blue-sensitive emulsion) is added to a photosensitive layer containing a yellow dye-providing compound, a silver halide emulsion spectrally sensitized in the region of from 500 to 600 nm (a green-sensitive emulsion) is added to a photosensitive layer containing a magenta dye-providing compound, and a silver halide emulsion spectrally sensitized in the region of from 600 to 740 nm (a red-sensitive emulsion) is added to a photosensitive layer containing a cyan dye-providing compound. However, the hues of dye-providing compounds and photosensitive wavelengths do not necessarily follow the above combinations and may be combined arbitrarily.

When a yellow photosensitive layer is colored yellow, it is preferably the uppermost photosensitive layer farther from the support. That is, the combination of a red-sensitive layer containing a cyan dye-providing compound, an interlayer, a green-sensitive layer containing a magenta dye-providing compound, an interlayer, a blue-sensitive layer containing a yellow dye-providing compound, an interlayer, and a protective layer from the support side.

If the order of a cyan layer anda magenta layer is reversed, the characteristics are nearly the same. Further, each photosensitive layer may comprise two layers and each layer may contain a dye-providing compound and a silver halide emulsion or, alternatively, a silver halide emulsion may be contained only in the upper layer and a dye-providing compound may be contained in the lower layer for the purpose of higher sensitization.

A heat-developable color photographic material may be provided with various auxiliary layers, e.g., a protective layer, an undercoat layer, an interlayer, a yellow filter layer, an antihalation layer, a backing layer, etc. A backing layer may further be provided with an underlayer and a protective layer.

If the support is a polyethylene laminate paper containing a white pigment such as titanium oxide, a backing layer is preferably designed to have an antistatic function and surface resistivity of $10^{12}$ Ω·cm or less.

A silver halide emulsion for use in the heat-developable color photographic material of the present invention will be described in detail.

The silver halide emulsion for use in the present invention contains at least one compound selected from metal ions and metal complex ions which are shallow electron traps, and further preferably contains at least one compound selected from metal ions and metal complex ions which are deep electron traps.

The value of the depth of electron trap by the above-described metal ion and/or metal complex ion can be obtained by dynamic measurement with ESR as described, e.g., in R. S. Eachus, R. E. Grave and M. T. Olm, *Phys. Stat. Sol* (*b*), Vol. 88, p. 705 (1978).

The depth of electron trap can be varied by the kinds of central metal ions, the kinds of ligands, the symmetric properties of the point groups of complexes (Oh, D4h, C4v, etc.), and the halogen composition of the host grain in silver halide. The above-described depth of electron trap is determined whether the minimum non-occupied orbital energy level of the electron of the metal ion or the metal complex ion is lower or higher than the bottom of the conduction band of the silver halide.

When the energy level is higher than the bottom of the conduction band of the silver halide, weak binding is given to the electron by Coulomb's force of the central metal ion, as a result, the electron trap becomes shallow, while when the energy level is lower, the energy difference from the conduction band responds to the depth of the electron trap, as a result, the electron trap becomes relatively deep.

As metal ions or the metal complex ions capable of becoming shallow electron trap, $Pb^{2+}$ and $M(CN)_xL_yT_z$ can be exemplified, wherein M represents $Fe^{2+}$, $Ru^{2+}$, $Os^{2+}$, $Co^{3+}$, $Ir^{3+}$, or $Re^{+}$; x represents 4, 5 or 6; L and T each represents a halide ion, such as a fluorine ion, a chlorine ion, a bromine ion, or an iodine ion, an inorganic ligand, such as $SCN^-$, $NCS^-$, or $H_2O$, or an organic ligand, such as pyridine, phenanthroline, imidazole, or pyrazole; andy and z each represents a positive integer and each value is determined so as to satisfy x+y+z=6. When a complex has a ligand, the coordination number is generally six.

The above-described depth of relatively deep electron trap is 0.35 eV or more, more preferably 0.5 eV or more.

As metal ions or the metal complex ions capable of becoming relatively deep electron trap, ions containing a halide ion ligand or a thiocyanate ion ligand, and Ir, Rh, Ru or Pb; ions containing at least one kind of nitrosyl ligands and Ru; and ions containing a cyan ligand and Cr can be exemplified. Of these, $[IrCl_6]^{3-}$, $[IrBr_6]^{3-}$, $[Ir(SCN)_6]^{3-}$, $[IrI_6]^{3-}$, $[RhCl_5(H_2O)]^{2-}$, $[RhCl_4(H_2O)_2]^{-}$, $[RuCl_5(NO)]^{2-}$, $[Cr(CN)_6]^{3-}$, $[RhCl_6]^{3-}$, $[RhBr_6]^{3-}$, and $[PbCl_6]^{5-}$ are preferably used.

There are disclosed in JP-A-2-236542, JP-A-5-181246, JP-A-8-314080 and U.S. Pat. No. 5,434,043 a method comprising incorporating an iron ion into the silver halide of the heat-developable photographic material into which a developing agent has been incorporated for the purpose of imparting to the photographic material the stability against the temperature·humidity fluctuation during development and exposure, a method comprising incorporating a polyvalent metal ion into the silver halide of the heat-developable photographic material for the purpose of lowering fog and increasing sensitivity, a method comprising incorporating Ir and Rh into a high silver chloride content emulsion for the purpose of achieving higher contrast even in high intensity exposure, and a method comprising incorporating Ir into silver iodobromide of the photographic material into which a developing agent such as a so-called dry silver has been incorporated for the purpose of imparting high intensity suitability to the photographic material. These techniques are, however, completely different from the technique of the present invention which intends to improve reciprocating writing unevenness resulted from multi-exposure using a plurality of light sources. It was found from the investigation by the present inventors that reciprocating writing unevenness resulted from multi-exposure using a plurality of light sources could be improved by incorporating a metal ion or a metal complex ion which is shallow electron trap into a silver halide grain.

The addition amount of the above-described metal ion or metal complex ion is from $10^{-9}$ to $10^{-2}$ mol per mol of the silver halide.

In the photosensitive silver halide grain, the above metal ion and/or metal complex ion (hereinafter sometimes referred to as "metal ion and the like") may be contained in the inside of the grain uniformly or locally, may be contained in the state exposed on the surface of the grain, or may be contained in the state not exposed on the surface of the grain but present locally in the vicinity of the surface of the grain. Further, in an epitaxial grain, metal ions and the like may be present in the crystal of a host grain, or may be present in the crystal of the joint. In a multi-structural type photosensitive silver halide grain having phases of different halogen compositions, metal ions and the like to be contained may be varied every composition.

The region where metal ions and the like are present may be a coexisting region of two kinds of metal ions, may comprise the region where metal ions and the like which are shallow electron traps alone are present and the region where metal ions and the like which are deep electron traps alone are present, may comprise the above coexisting region and the region where metal ions and the like which are shallow electron traps alone are present and/or the region where metal ions and the like which are deep electron traps alone are present, or the region where metal ions and the like are not present at all may be present in the above five regions.

The addition of the above metal ions and the like is performed in a manner that a metal salt solution of the above metal ions and the like is mixed with an aqueous halide solution or a water-soluble silver salt solution at the time of grain formation and continuously added during grain formation, or silver halide emulsion fine grains doped with the metal ions and the like is added, or a metal salt solution of the metal ions and the like is directly added before, during or after grain formation. A metal salt solution of the metal ions and the like may be continuously added during grain formation.

When the above metal salt is dissolved in water or an appropriate solvent such as methanol or acetone, a method of adding a hydrogen halide solution (e.g., HCl, HBr, etc.), a thiocyanic acid or a salt thereof, or an alkali halide (e.g., KCl, NaCl, KBr, NaBr, etc.) may be used for stabilizing the solution. Addition of an acid or an alkali according to necessity is also preferred in view of stabilizing the solution.

The content of the above metal ions and the like in a photosensitive silver halide emulsion is determined by atomic absorption, polarization Zeeman spectroscopy, or ICP analysis. The presence of CN—, SCN—, NO—, etc., in the ligand of a metal complex ion is confirmed by infrared absorption measurement.

The silver halide emulsion may contain gold in an amount of from $1.0\times10^{-7}$ to $1.0\times10^{-4}$ mol, preferably from $5.0\times10^{-7}$ to $5.0\times10^{-5}$ mol, per mol of the silver.

This amount of gold is the amount finally contained in the silver halide emulsion. Gold is added when the silver halide emulsion is prepared, specifically added mainly when the emulsion is subjected to chemical sensitization. The time of addition is not particularly restricted in the present invention.

As described later, gold may be added at any stage of chemical sensitization. Gold may be added after the termination of the chemical sensitization process and before coating, or it may be added after grain formation and before removal of the excess salt.

Gold of the amount within the above range may be added in parts during gold sensitization, and may be added continuously or intermittently. Further, gold of the less amount than the amount of the above range may be added in chemical sensitization in the first place and the shortage may be supplied during the period of time after the termination of the chemical sensitization and just before coating. The present inventors have found that when a gold·sulfur sensitized silver halide emulsion is applied to a heat-developable photographic material, heat fogging in the photographic material primarily depends upon the amount of gold used in the chemical sensitization. The content of gold in a silver halide emulsion was determined as the above range based on this knowledge. When the content of gold is out of the above range, i.e., when the amount of gold exceeds $1.0\times10^{-4}$ mol, heat fogging is liable to occur, while when it is less than $1.0\times10^{-4}$ mol, an apparent effect of gold sensitization cannot be obtained.

A gold sensitizer mainly exists on the surface of silver halide grains in a silver halide emulsion layer but a part of a sensitizer may be present in binder gelatin.

The oxidation number of the gold sensitizers for gold sensitization of the present invention may be monovalent (+1) or trivalent (+3) and specific examples thereof include chloroaurate, potassium chloroaurate, auric trichloride, potassium auric thiocyanate, potassium iodoaurate, and tetracyanoauric acid.

Gold sensitization may be used alone, or preferably gold sensitization is used in combination with sulfur sensitization or selenium sensitization. Other chemical sensitization, e.g., reduction sensitization and the like, may be used in combination.

Chemical sensitization is performed on conditions of the temperature of from 40 to 90° C., preferably from 45 to 75° C., pH of from 3 to 9, preferably from 4 to 8, and pAg of from 5 to 11, preferably from 6 to 9.

Gold sensitization and sulfur sensitization can be used in combination as described above. As sulfur sensitizers, compounds containing sulfur capable of reacting with active gelatin and silver, e.g., thiosulfate, allyl thiocarbamido, thiourea, allyl isothiocyanate, cystine, p-toluenethiosulfonate, rhodanine, and mercapto compounds can be exemplified.

In addition to the above, the sulfur sensitizers disclosed in U.S. Pat. Nos. 1,547,944, 2,410,689, 2,278,947, 2,728,668, and 3,656,955 can also be used.

Sulfur sensitizers can be used in the range of from $10^{-7}$ to $10^{-2}$ mol per mol of the silver.

Selenium sensitization can also be used in the present invention as described above. Selenium sensitizers which can be used in the present invention include aliphatic isoselenocyanates such as allylisoselenocyanate, selenoureas, selenoketones, selenoamides, selenocarboxylic acids and selenocarboxylate, selenophosphates, and selenides such as diethylselenide and diethyldiselenide. Specific examples of these selenium sensitizers are disclosed in U.S. Pat. Nos. 1,574,944, 1,602,592, and 1,623,499.

Selenium sensitizers can be used in the range of from $10^{-7}$ to $10^{-2}$ mol per mol of the silver.

Other sensitization methods which can be used in combination in the present invention include a reduction sensitization method using reducing substances (e.g., stannous salt, amines, hydrazine derivatives, formamidinesulfinic acid, silane compounds), and a noble metal sensitization method using a noble metal compound (e.g., complex salts of metals belonging to group VIII of the Periodic Table such as Pt, Ir, Pd).

A reduction sensitization method is disclosed in U.S. Pat. Nos. 2,983,609, 2,419,974 and 4,054,458, and a noble metal sensitization method is disclosed in U.S. Pat. Nos. 2,399,083, 2,448,060 and British Patent 618,061.

When gold sensitization is performed in combination with sulfur sensitization or selenium sensitization, a gold sensitizer maybe added simultaneously with a sulfur sensitizer or a selenium sensitizer, or may be added during or after sulfur sensitization or selenium sensitization. This is the same when other chemical sensitization methods are used in combination.

In the present invention, these gold sensitizer and other chemical sensitizers are added to a silver halide photographic emulsion according to ordinary methods. That is, water-soluble compounds are added as aqueous solutions, and organic solvent-soluble compounds are added as solutions of organic solvents easily soluble with water, e.g., methanol and ethanol.

Chemical sensitization can be performed in the presence of nitrogen-containing heterocyclic compounds (e.g., as disclosed in British patent 1,315,755, JP-A-50-63914, JP-A-51-77223, JP-A-58-126526, and JP-A-58-215644).

It is preferred to perform chemical sensitization in the presence of acetylene compounds as disclosed in JP-B-39-22067 and JP-A-39-22068 (the term "JP-B" as used herein means an "examined Japanese patent publication") for obtaining a silver halide emulsion of low fog.

It is also preferred to perform chemical sensitization in the presence of silver halide solvents. Thiocyanate and solvents disclosed in JP-A-63-151618 can be used.

Silver halide emulsions for use in the present invention maybe any of silver chloride, silver bromide, silver iodobromide, silver chlorobromide, silver chloroiodide and silver chloroiodobromide.

Silver halide emulsions for use in the present invention may be a surface latent image type emulsion or an internal latent image type emulsion. An internal latent image type emulsion is used as adirect reversal emulsion in combination with a nucleating agent and light fogging. In addition, a so-called core/shell type emulsion in which the grain interior and the grain surface layer have different phases may be used, or silver halides which have different compositions may be joined by epitaxial junction. Silver halide emulsions may be monodisperse or polydisperse. A method of blending monodisperse emulsions and controlling gradation as disclosed in JP-A-1-167743 and JP-A-4-223463 is preferably used in the present invention. The grain size of silver halide grains is from 0.1 to 2 $\mu$m, and particularly preferably from 0.15 to 1.0 $\mu$m. Crystal habit of silver halide grains is not restricted and crystals may take any form such as a regular crystal form such as a cubic, octahedral or tetradecahedral form, an irregular crystal form such as a spherical form or a tabular form having high aspect ratio, a form which has twin crystal defects such as twin planes, or a form which is a composite of these forms and others.

A silver halide photographic emulsion for use in the present invention can be prepared using the methods disclosed, for example, in column 50, U.S. Pat. Nos. 4,500,626, 4,628,021, Research Disclosure (hereinafter abbreviated to RD), No. 17029 (1978), RD, No. 17643 (December, 1978), pp. 22 and 23, RD, No. 18716 (November, 1979), p. 648, RD, No. 307105 (November, 1989), pp. 863 to 865, JP-A-62-253159, JP-A-64-13546, JP-A-2-236546, JP-A-3-110555, P. Glafkides, Chimie et Phisique Photographique, Paul Montel (1967), G. F. Duffin, Photographic Emulsion Chemistry, Focal Press (1966), and V. L. Zelikman et al., Making and Coating Photographic Emulsion, Focal Press (1964).

In the process of preparation of a photosensitive silver halide emulsion according to the present invention, it is preferred to perform desalting for removing excess salt. Desalting may be conducted by a noodle washing method by gelation of gelatin, or a precipitation method using inorganic salts comprising polyvalent anions (e.g., sodium sulfate), anionic surfactants, anionic polymers (e.g., sodium polystyrenesulfonate), or gelatin derivatives (e.g., aliphatic acylated gelatin, aromatic acylated gelatin, aromatic carbamoylated gelatin). A precipitation method is preferably used.

In the grain formation stage of a photosensitive silver halide emulsion of the present invention, a silver halide solvent such as rhodan salt, ammonia, or tetra-substituted thioether compounds, organic thioether derivatives disclosed in JP-B-47-11386, or sulfur-containing compounds disclosed in JP-A-53-144319 can be used.

With respect to other conditions, the description in the above P. Glafkides, Chimie et Phisique Photographique, Paul Montel (1967), G. F. Duffin, Photographic Emulsion Chemistry, Focal Press (1966), and V. L. Zelikman et al., Making and Coating Photographic Emulsion, Focal Press (1964) can be referred to. That is, any process, such as an acid process, a neutral process, and an ammoniacal process can be used. A single jet method, a double jet method, and a combination of these methods are known as methods for reacting a soluble silver salt with a soluble halide, and any of these methods can be used. A double jet method is preferably used for obtaining a monodispersed emulsion.

A reverse mixing method in which grains are formed in the presence of excess silver ion can also be used. A method in which the pAg in the liquid phase in which the silver halide is formed is kept constant, that is, the controlled double jet method, can also be used as one type of the double jet method.

For accelerating the grain growth, the addition concentration, the addition amount and the addition rate of silver salt and halide may be increased (e.g., JP-A-55-142329, JP-A-55-158124 and U.S. Pat. No. 3,650,757).

Any well-known stirring means can be used for stirring a reaction solution. The temperature and pH during formation of silver halide grains may be set arbitrarily according to purposes. pH is preferably from 2.2 to 8.5, more preferably from 2.5 to 7.5.

The coating amount of a photosensitive silver halide emulsionfor usein the present invention is from 1 mg/m$^2$ to 10 g/m$^2$ calculated in terms of silver.

For imparting color sensitivity to a silver halide emulsion for use in the present invention in blue wavelength region, green wavelength region, red wavelength region, and infrared wavelength region, a photosensitive silver halide emulsion is spectrally sensitized using methine dyes and other dyes. Dyes which are used include a cyanine dye, a merocyanine dye, a complex cyanine dye, a complex merocyanine dye, a holopolar cyanine dye, a hemicyanine dye, a styryl dye, and a hemioxonol dye. Specifically, sensitizing dyes disclosed in U.S. Pat. No. 4,617,257, JP-A-59-180550, JP-A-64-13546, JP-A-5-45828, JP-A-5-45834, RD, No. 17643, RD, No. 18716, and RD, No. 307105 can be exemplified.

These sensitizing dyes can be used in combination for the purpose of supersensitization, the control of color sensitivity, etc. Number of sensitizing dyes which are used in combination is preferably 2 or more and less than 5, but 6 or more sensitizing dyes can be used in combination.

A dye having no spectral sensitizing function by itself or a compound which does not substantially absorb visible light but shows supersensitization may be contained in an emulsion together with sensitizing dyes (e.g., those disclosed in U.S. Pat. No. 3,615,641 and JP-A-63-23145).

These sensitizing dyes may be added to an emulsion before, during or after chemical sensitization, alternatively they may be added before or after the nucleation of silver halide grains as disclosed in U.S. Pat. Nos. 4,183,756 and 4,225,666. Sensitizing dyes and supersensitizers may be added as a solution of organic solvent, e.g., methanol, as a gelatin dispersion, or as a solution of surfactant. The addition amount is generally from about $10^{-8}$ to $10^{-2}$ mol per mol of the silver halide.

Additives for use in these processes and well-known photographic additives which can be used in heat-developable photographic materials and dye-fixing materials of the present invention are described in the above Research Disclosure, No. 17643, No. 18716 and No. 307105, and the locations related thereto are summarized in the table below.

| Type of Additives | RD 17643 | RD 18716 | RD 307105 |
|---|---|---|---|
| 1. Chemical Sensitizers | page 23 | page 648, right column | page 866 |
| 2. Sensitivity Increasing Agents | — | page 648, right column | — |
| 3. Spectral Sensitizers and Supersensitizers | pages 23–24 | page 648, right column to page 649, right column | pages 866–868 |
| 4. Brightening Agents | page 24 | page 648, right column | page 868 |
| 5. Antifoggants and Stabilizers | pages 24–25 | page 649, right column | pages 868–870 |
| 6. Light Absorbers, Filter Dyes, and Ultraviolet Absorbers | pages 25–26 | page 649, right column to page 650, left column | page 873 |
| 7. Dye Image Stabilizers | page 25 | page 650, left column | page 872 |
| 8. Hardening Agents | page 26 | page 651, left column | pages 874–875 |
| 9. Binders | page 26 | page 651, left column | pages 873–874 |
| 10. Plasticizers and Lubricants | page 27 | page 650, right column | page 876 |
| 11. Coating Aids and Surfactants | pages 26–27 | page 650, right column | pages 875–876 |
| 12. Antistatic Agents | page 27 | page 650, right column | pages 876–877 |
| 13. Matting Agents | — | — | pages 878–879 |

Hydrophilic binders are preferably used as a binder in the constitutional layers of a heat-developable photographic material and a dye-fixing material of the present invention. Examples are described in the above Research Disclosures and JP-A-64-13546, pp. 71 to 75. Specifically, transparent or translucent hydrophilic binders are preferably used, for example, natural compounds such as proteins, e.g., gelatin and gelatin derivatives, polysaccharides, e.g., cellulose derivatives, starch, gum arabic, dextran, and pullran, and synthetic high polymers, e.g., polyvinyl alcohol, polyvinyl pyrrolidone, and acrylamide. Further, highly water-soluble polymers disclosed in U.S. Pat. No. 4,960,681 and JP-A-62-245260, i.e., homopolymers of a vinyl monomer having —COOM or —$SO_3M$ (wherein M represents a hydrogen atom or alkali metal), or copolymers of this monomer unit or with other vinyl monomer (e.g., sodium methacrylate, ammonium methacrylate, Sumikagel L-5H, a product of Sumitomo Chemical Co., Ltd.) can also be used. These binders can be used in combination of two or more. Combinations of gelatin with above binders are particularly preferred. Gelatin may be selected according to purposes from lime-processed gelatin, acid-processed gelatin, or a so-called delimed gelatin in which the contents of calcium, etc., are reduced, and it is also preferred to use these gelatins in combination.

When a system of performing heat development with supplying a trace amount of water is employed, it becomes possible to expedite water absorption by using the above highly water-soluble polymer. Further, when a highly water-soluble polymer is used in a dye-fixing layer or protective layers thereof, retransferring of dyes from the dye-fixing layer to others after transfer can be prevented.

The coating amount of a binder in the present invention is preferably 20 g/$m^2$ or less, more preferably 10 g/$m^2$ or less, and most preferably from 7 g to 0.5 g/$m^2$.

In the present invention, organic metal salts can be used as an oxidizing agent together with a photosensitive silver halide emulsion. Of such organic metal salts, an organic silver salt is particularly preferably used.

Examples of organic compounds which can be used for forming the above organic silver salt oxidizing agent include benzotriazoles, fatty acid, and other compounds disclosed in U.S. Pat. No. 4,500,626, columns 52 and 53. Acetylene silver disclosed in U.S. Pat. No. 4,775,613 is also useful. Two or more organic silver salts may be used in combination.

The above organic silver salts can be used in combination in an amount of from 0.01 to 10 mol, preferably from 0.01 to 1 mol, per mol of the photosensitive silver halide. The total coating amount of the photosensitive silver halide emulsion and the organic silver salt is from 0.05 to 10 g/$m^2$, preferably from 0.1 to 4 g/$m^2$, calculated in terms of silver.

As reducing agents for use in the present invention, reducing agents known in the field of the heat-developable photographic material can be used. In addition, the dye-providing compounds having reductivity described later can be included in the reducing agent (in such a case, other reducing agents can be used in combination). Further, reducing agent precursors which themselves do not have reductivity but show reductivity during the process of development by the action of a nucleophilic reagent and heat can also be used.

Examples of reducing agents which can be used in the present invention include reducing agents and reducing agent precursors disclosed in U.S. Pat. Nos. 4,500,626, columns 49 and 50, 4,839,272, 4,330,617, 4,590,152, 5,017,454, 5,139,919, JP-A-60-140335, pp. 17 and 18, JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-201434, JP-A-62-244044, JP-A-62-131253, JP-A-62-131256, JP-A-63-10151, JP-A-64-13546, pp. 40 to 57, JP-A-1-120553, JP-A-2-32338, JP-A-2-35451, JP-A-2-234158, JP-A-3-160443, and European Patent 220746, pp. 78 to 96.

Combinations of various reducing agents as disclosed in U.S. Pat. No. 3,039,869 can also be used.

When diffusion resisting reducing agents are used, if required, an electron transferring agent and/or a precursor of an electron transferring agent can be used in combination to accelerate electron transfer between a diffusion resisting reducing agent and developable silver halide. Electron transferring agents disclosed in U.S. Pat. No. 5,139,919, European Patent Publication 418743, JP-A-1-138556 and JP-A-3-102345 are particularly preferably used. A method of stably introducing an electron transferring agent to the layer as disclosed in JP-A-2-230143 and JP-A-2-235044 is preferably used.

Electron transferring agents or the precursors thereof can be selected from among the above-described reducing agents or precursors thereof. It is preferred for the electron transferring agent or the precursor thereof to have transferability larger than that of the diffusion resisting reducing agent (an electron donor). Particularly preferred electron transferring agents are 1-phenyl-3-pyrazolidones or aminophenols.

In the above-described reducing agents, diffusion resisting reducing agents (electron donors) to be used in combination with an electron transferring agent are enough if they substantially do not transfer in the layer of a photographic material, preferably hydroquinones, sulfonamidophenols, sulfonamidonaphthols, compounds disclosed in JP-A-53-110827, U.S. Pat. Nos. 5,032,487, 5,026,634 and 4,839,272 as electron donors, and diffusion resisting dye-providing compounds having reductivity as described later can be exemplified Electron donor precursors disclosed in JP-A-3-160443 are also preferably used.

The above-described reducing agents can be used in an interlayer or a protectivelayerforvarious purposes suchascolor mixing prevention, color reproduction improvement, whiteness improvement, prevention of silver transfer to a dye-fixing material and the like. Specifically, reducing agents disclosed in European Patent Publications 524649, 357040, JP-A-4-249245, JP-A-2-64633, JP-A-2-46450 and JP-A-63-186240 are preferably used. Development inhibitor-releasing reducing compounds disclosed in JP-B-3-63733, JP-A-1-150135, JP-A-2-110557, JP-A-2-64634, JP-A-3-43735, European Patent Publication 451833 are also used.

The total addition amount of reducing agents in the present invention is from 0.01 to 20 mol, particularly preferably from 0.1 to 10 mol, per mol of the silver.

In the present invention, compounds which release a diffusible dye corresponding to the reaction of reducing a silver ion to silver under high temperature, i.e., a dye-providing compound are used.

As the example of a dye-providing compound, a compound having the function of imagewise releasing a diffusible dye can be exemplified. A compound of this type can be represented by the following formula (L1):

$$[(\text{Dye})_m\text{—Y}]_n\text{—Z} \qquad \text{(L1)}$$

wherein Dye represents a dye group or a dye precursor group, or a dye group or a dye precursor group which is shifted to shortwave temporarily; Y represents a single bond or a linking group; Z represents a group having the function of imagewise making difference in diffusibility of the compound represented by $[(\text{Dye})_m\text{—Y}]_n\text{—Z}$ corresponding to photosensitive silver salt having imagewise a latent image, or releasing $(\text{Dye})_m\text{—Y}$ and differentiating the released $(\text{Dye})_m\text{—Y}$ from $[(\text{Dye})_m\text{—Y}]_n\text{—Z}$ in diffusibility; m represents an integer of from 1 to 5; and n represents an integer of 1 or 2, and when either of m or n does not represents 1, a plurality of Dyes may be the same or different. Specific examples of the dye-providing compounds represented by formula (L1) include the compounds belonging to the following (1) or (2).

(1) Couplers which have a diffusible dye as a separable group and release the diffusible dye upon reaction with the oxidized product of a reducing agent and are nondiffusible compounds themselves (DDR couplers). Specific examples are disclosed in British Patent 1,330,524, JP-B-48-39165, U.S. Pat. Nos. 3,443,940, 4,474,867, and 4,483,914.

(2) Compounds which are reducible against silver halide or organic silver salt and release a diffusible dye when the object is reduced and are nondiffusible compounds themselves (DRR compounds). Representative examples are disclosed in U.S. Pat. Nos. 3,928,312, 4,053,312, 4,055,428, 4,336,322, JP-A-59-65839, JP-A-59-69839, JP-A-53-3819, JP-A-51-104343, RD, No. 17465, U.S. Pat. Nos. 3,725,062, 3,728,113, 3,443,939, JP-A-58-116537, JP-A-57-179840, and U.S. Pat. No. 4,500,626.

Specific examples of DRR compounds are those disclosed in U.S. Pat. No. 4,500,626, columns from 22 to 44, and Compounds (1) to (3), (10) to (13), (16) to (19), (28) to (30), (33) to (35), (38) to (40), (42) to (64) disclosed in U.S. Pat. No. 4,500,626 are preferred above all. Further, compounds disclosed in U.S. Pat. No. 4,639,408, columns from 37 to 39 are also useful.

In addition to the above-described couplers and the dye-providing compound represented by formula (L1), the dye silver compound combining organic silver salt and a dye (e.g., described in Research Disclosure, May, 1978, pp. 54 to 58), azo dyes used for a heat developing silver dye bleaching method (e.g., described in U.S. Pat. No. 4,235,957, Research Disclosure, April, 1976, pp. 30 to 32, and leuco dyes (e.g., disclosed in U.S. Pat. Nos. 3,985,565 and 4,022,617) can also be used as a dye-providing compound.

DRR compounds are preferably used in the present invention.

Hydrophobic additives such as a dye-providing compound and a diffusion resisting reducing agent can be introduced into the layer of a heat-developable photographic material by well-known methods as disclosed in U.S. Pat. No. 2,322,027. In such a case, a high boiling point organic solvent disclosed in U.S. Pat. Nos. 4,555,470, 4,536,466, 4,536,467, 4,587,206, 4,555,476, 4,599,296, and JP-B-3-62256 can be used in combination with a low boiling point organic solvent having a boiling point of from 50 to 160° C., according to necessity. These dye-providing compound, diffusion resisting reducing agent and high boiling point organic solvent can be used in combination of two or more.

The amount of a high boiling point organic solvent is 10 g or less, preferably 5 g or less, and more preferably from 1 g to 0.1 g, per gram of the dye-providing compound to be used. Further, the content is 1 ml or less, preferably 0.5 ml or less, and particularly preferably 0.3 ml or less, per gram of the binder.

These additives can also be added as a dispersion by a polymerization product as disclosed in JP-B-51-39853 and JP-A-51-59943 and as a fine particle dispersion as disclosed in JP-A-62-30242.

When compounds are substantially water-insoluble, they can be added as a fine particle dispersion in a binder, besides the above methods.

Various surfactants can be used for dispersing a hydrophobic compound in hydrophilic colloid. For example, surfactants as disclosed in JP-A-59-157636, pp. 37 and 38 and the above Research Disclosures.

A compound aiming at activation of development and, at the same time, stabilization of the image can be used in a heat-developable photographic material according to the present invention. Specific examples of compounds preferably used are disclosed in U.S. Pat. No. 4,500,626, columns 51 and 52.

In an image-forming system by diffusion transferring of a dye, various compounds can be added to constitutional layers of a heat-developable photographic material of the present invention for the purpose of immobilizing unnecessary dyes or colorants or making unnecessary dyes or colorants colorless to improve the whiteness of the image obtained.

Specifically, compounds disclosed in European Patent Publications 353741, 461416, JP-A-63-163345 and JP-A-62-203158 can be used.

A variety of pigments and dyes can be used in constitutional layers of a heat-developable photographic material of the present invention for improving a color isolating property and for increasing sensitivity.

Specifically, compounds described in the above Research Disclosures and compounds and layer constitutions disclosed in European Patent Publications 479167, 502508, JP-A-1-167838, JP-A-4-343355, JP-A-2-168252 and JP-A-61-20943 can be used.

In an image-forming systembydiffusion transfer of adye, a dye-fixing material is used together with a heat-developable photographic material. A dye-fixing material may be coated on a different support from the support of a photographic material or may be coated on the same support as the support of a photographic material. The mutual relationship between a photographic material and a dye-fixing material, the relationships with a support and with a white reflecting layer disclosed in U.S. Pat. No. 4,500,626, column 57 can be applied to the present invention.

A dye-fixing material preferably used in the present invention has at least one layer containing a mordant and a binder. Known mordants in the photographic field can be used in the present invention. Mordants disclosed in U.S. Pat. No. 4,500,626, columns 58 and 59, JP-A-61-88256, pp. 32 to 41, JP-A-1-161236, pp. 4 to 7, U.S. Pat. Nos. 4,774,162, 4,619,883, and 4,594,308 can be exemplified as specific examples. Dye-accepting high polymers disclosed in U.S. Pat. No. 4,463,079 can also be used.

The above-described hydrophilic binders are preferably used in a dye-fixing material according to the present invention. Further, it is preferred to use carrageenans disclosed in European Patent Publication 443529 and latexes having a glass transition point of 40° C. or less disclosed in JP-B-3-74820 in combination.

A dye-fixing material can be provided with an auxiliary layer such as aprotective layer, apeeling-off layer, an undercoat layer, an interlayer, a backing layer, a curl preventive layer and the like. In particular, the provision of a protective layer is useful. A backing layer may further be provided with an underlayer and a protective layer.

A plasticizer, a sliding agent, or a high boiling point organic solvent as an improver of a peeling property of a photographic material and a dye-fixing material can be used in constitutional layers of a heat-developable photographic material and a dye-fixing material of the present invention. Specific examples are disclosed in the above Research Disclosures and JP-A-62-245253.

Further, various kinds of silicone oils (every kind of silicone oil from dimethylsilicon oil to modified silicone oil such as dimethylsiloxane having incorporated therein various organic groups) can be used for the above purpose. As examples, various kinds of modified silicone oils described in *Modified Silicone Oils*, technical information, pp. 6 to 18B, published by Shin-Etsu Silicone Co. Ltd., in particular, a carboxy-modified silicone oil (trade name: X-22-3710), are useful.

Silicone oils disclosed in JP-A-62-215953 and JP-A-63-46449 are also useful.

A discoloration inhibitor may be used in a heat-developable photographic material and a dye-fixing material of the present invention. Examples of discoloration inhibitors include, e.g., an antioxidant, an ultraviolet absorber or a certain kind of a metal complex. Dye image stabilizers and ultraviolet absorbers described in the above Research Disclosures are also useful.

Examples of antioxidants include, e.g., a chroman based compound, a coumaran based compound, a phenol based compound (e.g., hindered phenols), a hydroquinone derivative, a hindered amine derivative and a spiroindane based compound. Compounds disclosed in JP-A-61-159644 are also useful.

Examples of ultraviolet absorbers include a benzotriazole based compound (e.g., U.S. Pat. No. 3,533,794, etc.), a 4-thiazolidone based compound (e.g., U.S. Pat. No. 3,352,681, etc.), a benzophenone compound (e.g., JP-A-46-2784, etc.), and other compounds disclosed in JP-A-54-48535, JP-A-62-136641 and JP-A-61-88256. Further, ultraviolet absorbing polymers disclosed in JP-A-62-260152 are also useful.

Examples of metal complexes which can be used in the present invention include compounds disclosed in U.S. Pat. Nos. 4,241,155, 4,245,018, columns 3 to 36, 4,254,195, columns 3 to 8, JP-A-62-174741, JP-A-61-88256, pp. 27 to 29, JP-A-63-199248, JP-A-1-75568 and JP-A-1-74272.

A discoloration inhibitor for preventing discoloration of dyes transferred to a dye-fixing material may be contained in a dye-fixing material in advance or may be supplied to a dye-fixing material from the outside, e.g., from the heat-developable photographic material or a transfer solvent, which is described later.

An antioxidant, an ultraviolet absorber and a metal complex may be used in combination of them.

A heat-developable photographic material and a dye-fixing material of the present invention may contain a brightening agent. In particular, it is preferred to incorporate a brightening agent into a dye-fixing material or supplied from the outside, e.g., from the heat-developable photographic material or a transfer solvent. As examples of brightening agents, compounds described in K. Veenkataraman compiled, *The Chemistry of Synthetic Dyes*, Vol. V, Chap. 8, and JP-A-61-143752 can be exemplified. Specifically, a stilbene based compound, a coumarin based compound, a biphenyl based compound, a benzoxazolyl based compound, a naphthalimide based compound, a pyrazoline based compound, and a carbostyril based compound can be cited.

A brightening agent can be used in combination with a discoloration inhibitor and an ultraviolet absorber. Specific examples of discoloration inhibitors, ultraviolet absorbers and brightening agents are disclosed in JP-A-62-215272, pp. 125 to 137, and JP-A-1-161236, pp. 17 to 43.

As a hardening agent for use in constitutional layers of a heat-developable photographic material and a dye-fixing material of the present invention, hardening agents disclosed in the above Research Disclosures, U.S. Pat. Nos. 4,678,739, column 41, 4,791,042, JP-A-59-116655, JP-A-62-245261, JP-A-61-18942 and JP-A-4-218044 can be exemplified. More specifically, an aldehyde based hardening agent (e.g., formaldehyde), an aziridine based hardening agent, an epoxy based hardening agent, a vinyl sulfone based hardening agent (e.g., N,N'-ethylene-bis (vinylsulfonylacetamide)ethane), an N-methylol based hardening agent (e.g., dimethylolurea), and a high polymer hardening agent (e.g., compounds disclosed in JP-A-62-234157) can be exemplified.

The use amount of these hardening agents is from 0.001 to 1 g, preferably from 0.005 to 0.5 g, per gram of the coated gelatin. A hardening agent may be added to any constitutional layer of a photographic material and a dye-fixing material, and may be divided and added in parts to two or more layers.

Constitutional layers of a heat-developable photographic material and a dye-fixing material of the present invention can contain various antifoggants, photographic stabilizers and precursors thereof. Specific examples of these compounds are disclosed in the above Research Disclosures, U.S. Pat. Nos. 5,089,378, 4,500,627, 4,614,702, JP-A-62-13546, pp. 7 to 9, 57 to 71 and 81 to 97, U.S. Pat. Nos. 4,775,610, 4,626,500, 4,983,494, JP-A-62-174747, JP-A-62-239148, JP-A-63-264747, JP-A-1-150135, JP-A-2-110557, JP-A-2-178650, and RD, 17643 (1978), pp. 24 and 25.

These compounds are used in an amount of preferably from $5\times10^{-6}$ to $1\times10^{-1}$ mol, more preferably from $1\times10^{-5}$ to $1\times10^{-2}$ mol, per mol of the silver.

Various surfactants can be used in constitutional layers of a heat-developable photographic material and a dye-fixing material of the present invention for various purposes such as coating aid, improvement of peeling-off property, improvement of sliding property, static prevention, and development acceleration. Specific examples of surfactants are disclosed in the above Research Disclosures, JP-A-62-173463 and JP-A-62-183457, etc.

Organic fluoro compounds can be contained in constitutional layers of a heat-developable photographic material and a dye-fixing material of the present invention for purposes of improvement of sliding property, static prevention, and improvement of peeling-off property. Representative examples of organic fluoro compounds include fluorine based surfactants disclosed in JP-B-57-9053, columns 8 to 17, JP-A-61-20944 and JP-A-62-135826, and a hydrophobic fluorine compound, such as an oily fluorine based compound such as a fluorine oil, or a solid fluorine compound resin such as a tetrafluoroethylene resin.

A matting agent can be used in a heat-developable photographic material and a dye-fixing material of the present invention for purposes of adhesion prevention, improvement of sliding property, and making a surface matting. Examples of matting agents include compounds such as benzoguanamine resin beads, polycarbonate resin beads, and AS resin beads disclosed in JP-A-63-274944 and JP-A-63-274952, besides compounds such as silicon dioxide, polyolefin and polymethacrylate disclosed in JP-A-61-88256, p. 29. In addition to the above, compounds disclosed in the above Research Disclosures can be used. These matting agents can be added not only to an uppermost layer (a protective layer) but also to a lower layer.

Moreover, a thermal solvent, a defoaming agent, a fungicide and biocide, colloidal silica, etc., may be contained in constitutional layers of a heat-developable photographic material and a dye-fixing material of the present invention. Specific examples of these additives are disclosed JP-A-61-88256, pp. 26 to 32, JP-A-3-11338 and JP-B-2-51496.

An image-forming accelerator can be used in a heat-developable photographic material and/or a dye-fixing material according to the present invention. An image-forming accelerator has functions of acceleration of the oxidation reduction reaction of a silver salt oxidizing agent and a reducing agent, acceleration of reactions such as the formation of a dye from a dye-providing compound, decomposition of a dye, or release of a diffusible dye, and acceleration of dye transfer from a heat-developable photographic material layer to a dye-fixing layer. An image-forming accelerator is classified, from physicochemical functions, into a base, a base precursor, a nucleophilic compound, a high boiling point organic solvent (oil) a thermal solvent, a surfactant, a compound having correlation with silver or silver ion. However, these material groups have, in general, composite function and invested with some of the above acceleration effects. Details thereof are disclosed in U.S. Pat. No. 4,678,739, columns 38 to 40.

A base precursor includes an organic acid and a salt of a base decarboxylated by heat, a compound releasing amines by intramolecular nucleophilic substitution reaction, Lossen rearrangement, or Beckmann rearrangement. Specific examples are disclosed in U.S. Pat. Nos. 4,511,493 and 4,657,848.

In a system performing heat development and dye transfer simultaneously in the presence of a small amount of water, it is preferred to incorporate a base and/or a base precursor in a dye-fixing material in view of increasing the storage stability of a heat-developable photographic material.

In addition to the above, combinations of hardly-soluble metal compounds and compounds which can react with metal ions constituting these hardly soluble metal compounds to form complexes (complex-forming compounds) disclosed in European Patent Publication 210660 and U.S. Pat. No. 4,740,445, and compounds which generate a base by electrolysis disclosed in JP-A-61-232451 can also be used as a base precursor. In particular, the former method is effective. These hardly-soluble metal compound and complex-forming compound are preferably added to a heat-developable photographic material and a dye-fixing material separately as disclosed in the above patents.

A variety of development stopping agents can be used in a heat-developable photographic material and/or a dye-fixing material according to the present invention for the purpose of obtaining constant images irrespective of the fluctuations in the processing temperature and the processing time during development.

A development stopping agent used herein means a compound which immediately neutralizes a base or reacts with a base to reduce the concentration of the base in the film to thereby stop development, or a compound which correlates with silver and silver salt to inhibit development. Specifically, an acid precursor which releases an acid by heating, an electrophilic compound which undergoes a substitution reaction with the coexisting base by heating, a nitrogen-containing heterocyclic compound, a mercapto compound and a precursor thereof. Details are disclosed JP-A-62-253159, pp. 31 and 32.

Supports which can undergo the processing temperature are used for a heat-developable photographic material and a dye-fixing material according to the present invention. In general, photographic supports such as paper and a synthetic high polymer (film) described in, for example, compiled by Nihon Shashin Gakkai, *Shashin Kogaku no Kiso, Gin-En Shashin-Hen* (*The Elementary Course of Photographic Engineering, Section of Silver Photography*), pp. 223 to 240, Corona Publishing Co. (1979) are exemplified. Specifically, polyethylene terephthalate, polyethylene naphthalate, polycarbonate, polyvinyl chloride, polystyrene, polypropylene, polyimide, celluloses (e.g., triacetyl cellulose) or films of these compounds to which a pigment such as titanium oxide is incorporated, synthetic paper of a film produced from polypropylene, mixed paper comprising synthetic resin pulp such as polyethylene and natural pulp, yankee paper, baryta paper, coated paper (in particular, cast coated paper), metal, cloth, glass, etc., are used.

They can be used alone, or as a support one or both surfaces of which is (are) laminated with a synthetic high polymer such as polyethylene. A pigment or a dye such as titanium oxide, ultramarine, carbon black, etc., can be added to this laminate layer, if necessary.

In addition to the above, supports disclosed in JP-A-62-253159, pp. 29 to 31, JP-A-1-161236, pp. 14 to 17, JP-A-63-316848, JP-A-2-22651, JP-A-3-56955 and U.S. Pat. No. 5,001,033 can also be used.

Back surfaces of these supports may be coated with a hydrophilic binder and semi-conductive metallic oxide such as alumina sol and tin oxide, and an antistatic agent such as carbon black or the like. Specifically, supports disclosed in JP-A-63-220246 can be used.

The surface of a support is preferably subjected to various surface treatments or undercoating for the purpose of improving the adhesion property with a hydrophilic binder.

A heat-developable photographic material and/or a dye-fixing material according to the present invention may have an electrically conductive exothermic layer as a heating means of heat development and diffusion transfer of a dye. Exothermic elements disclosed in JP-A-61-145544 can be used in such a case.

The heating temperature in heat development process is from about 50° C. to 250° C., in particular, the temperature of from 60° C. to 180° C. is useful. Diffusion transfer process of a dye may be carried out simultaneously with heat development process, or may be conducted after termination of heat development process. In the latter case, the diffusion transfer of a dye can be performed at temperature range of from the temperature of heat development process to room temperature but, in particular, from 50° C. or more to the temperature lower than the temperature of heat development process by 10° C. is preferred.

The transfer of a dye is effected only with heating but a solvent may be used for accelerating the dye transfer. A method of performing development and transfer at the same time or succeedingly by heating in the presence of a small amount of a solvent (in particular, water) as disclosed in U.S. Pat. Nos. 4,704,345, 4,740,445, and JP-A-61-238056 is also effective. In this system, heating temperature is preferably 50° C. or more and not higher than the boiling point of a solvent, for example, when water is used as a solvent, the temperature is preferably from 50° C. to 100° C.

As examples of solvents for the acceleration of development and/or the diffusion transfer of a dye, water, a basic aqueous solution containing inorganic alkali metal salt and organic base (those described above as image-forming accelerators can be used as such a base), a low boiling point solvent, a mixed solution of a low boiling point solvent with water or with the above-described basic aqueous solution can be exemplified. Surfactants, antifoggants, complex-forming compounds with hardly soluble metal salts, fungicides, and biocides can be contained in a solvent.

Water is preferably used as a solvent in heat development and diffusion transfer processes, and any water which is generally used as water can be used, e.g., distilled water, tap water, well water, mineral water, etc. In a heat development processor for a heat-developable photographic material and a dye-fixing material according to the present invention, water may be non-returnable type or may be used repeatedly by circulating. In the latter case, the water containing the ingredients diluted from the material is to be used. Apparatuses or waters disclosed in JP-A-63-144354, JP-A-63-144355, JP-A-62-38460, and JP-A-3-210555 may be used.

A method of imparting a solvent to a heat-developable photographic material or a dye-fixing material or both of them can be used. The use amount of a solvent should be sufficient in such an amount as not more than the weight of the solvent corresponding to the maximum swollen volume of the total coated film.

Methods of imparting water to a heat-developable photographic material or a dye-fixing material disclosed, for example, in JP-A-62-253159, p. 5 and JP-A-63-85544 are preferably used. A solvent can be used by being microencapsulated or in the form of a hydrate and incorporated into a heat-developable photographic material or a dye-fixing material or both of them in advance.

The temperature of water to be imparted should be sufficient in the range of from 30° C. to 60° C. as disclosed in JP-A-63-85544. It is preferred to increase the temperature to 45° C. or more for preventing bacteria from proliferating in water.

A method of incorporating a hydrophilic thermal solvent, which is solid at room temperature but dissolves at high temperature, into a heat-developable photographic material and/or adye-fixing material can also be employed for accelerating dye transfer. A hydrophilic thermal solvent may be incorporated into any layer of a silver halide emulsion layer, an interlayer, a protective layer, or a dye-fixing layer, but is preferably incorporated into a dye-fixing layer and/or adjacent layers thereto.

Examples of hydrophilic thermal solvents include ureas, pyridines, amides, sulfonamides, imides, alcohols, oximes and other heterocyclic compounds.

Heating method in development and/or transfer process include bringing a material into contact with a heated block or plate, a hot plate, a hot presser, a hot roller, a hot drum, a halogen lamp heater, an infrared or far infrared lamp heater, or passing a material through atmosphere of high temperature. It is also possible to irradiate all the surface of a material with a high output laser to give heat.

Methods of superposing a heat-developable photographic material on a dye-fixing material as disclosed in JP-A-62-253159 and JP-A-61-147244, p. 27 can be applied to the present invention.

The present invention will be described in detail with reference to specific examples but the present invention should not be construed as being limited thereto.

EXAMPLE 1

Preparation of Photosensitive Silver Halide Emulsion

Photosensitive Silver Halide Emulsion (1) (for red-sensitive emulsion layer)

Solution (I) having the composition shown in Table 1 was added over 9 minutes at a constant flow rate to an aqueous gelatin solution with thoroughly stirring (600 g of gelatin, 180 g of sodium chloride, 28 g of citric acid, and 96 ml of a 1% aqueous solution of Compound (a) were added to 39 liters of water and the temperature was maintained at 45° C.), and Solution (II) was added simultaneously with Solution (I) over 10 minutes at a constant flow rate. After 5 minutes, Solution (III) having the composition shown in Table 1 was added over 10 minutes at a constant flow rate, and Solution (IV) was added simultaneously with Solution (III) over 10 minutes at a constant flow rate. Subsequently, 9.2 g of Sensitizing Dye (a1), 8.9 g of Sensitizing Dye (a2), and 3.7 g of Sensitizing Dye (a3) were added to the mixed solution and stirred at 45° C. for 8 minutes.

After the reaction solution was washed with water by ordinary method and desalted (Precipitant (b) was used, pH was 3.3), 1,500 g of lime-processed ossein gelatin, 12 g of sodium chloride and 8.4 g of Compound (b) were added and pH was adjusted to 6.0. After the temperature was raised to 60° C., 49 g of sodium chloride, 640 mg of Compound (e), 123 mg of sodium thiosulfate, and 140 mg of chloroauric acid were further added and chemical sensitization was performed for 15 minutes, then 6.9 g of Sensitizing Dye (a1) and 1.9 g of Sensitizing Dye (a2) were added and further stirred for 35 minutes, and then 3.3 g of Antifoggant (1) and 163.5 g of Compound (c) were added in order and the reaction solution was cooled. Thus, 38.4 kg of a monodispersed cubic silver chlorobromide emulsion having an average grain size of 0.24 $\mu$m was obtained.

TABLE 1
| | Solution I | Solution II | Solution III | Solution IV |
|---|---|---|---|---|
| $AgNO_3$ | 3,000 g | — | 3,000 g | — |
| KBr | — | 1,051 g | — | 1,050 g |
| NaCl | — | 714 g | — | 515 g |
| Water to make | 10,740 ml | 12,750 ml | 5,280 ml | 7,760 ml |
Compound (a)
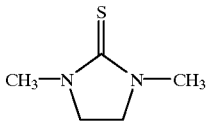
Compound (b)
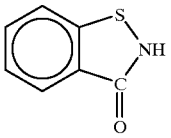
Compound (c)
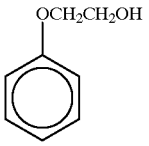
Compound (e)
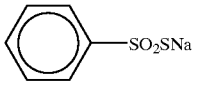
Precipitant (b)
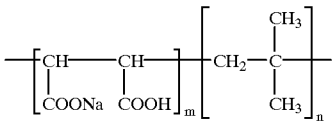
m + n = 1
Antifoggant (1)
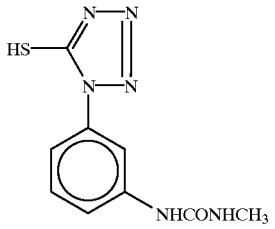
Sensitizing Dy (a1)

TABLE 1-continued

| | Solution I | Solution II | Solution III | Solution IV |
|---|---|---|---|---|

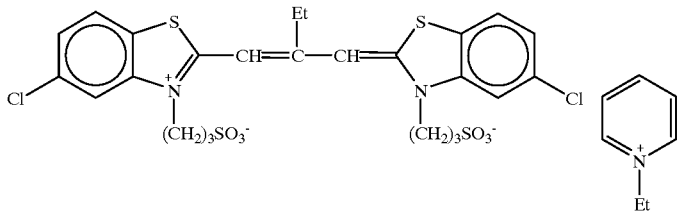

Sensitizing Dye (a2)

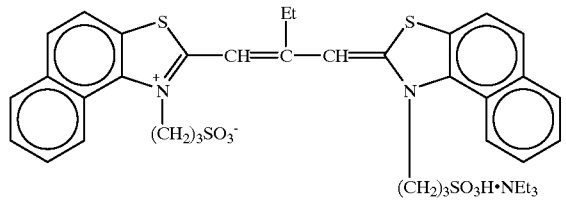

Sensitizing Dye (a3)

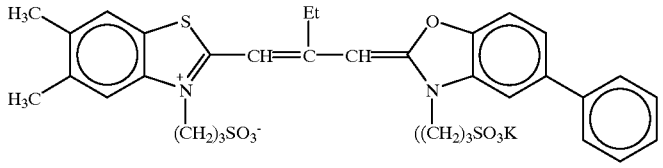

Photosensitive Silver Halide Emulsion (2) (for green-sensitive emulsion layer)

Solution (I) having the composition shown in Table 2 was added over 24 minutes at a constant flow rate to an aqueous gelatin solution with thoroughly stirring (630 g of gelatin, 189 g of sodium chloride, 30 g of citric acid, and 63 ml of a 1% aqueous solution of Compound (a) were added to 41 liters of water and the temperature was maintained at 45° C.), and Solution (II) was added simultaneously with Solution (I) over 24 minutes at a constant flow rate. After 5 minutes, Solution (III) having the composition shown in Table 2 was added over 15 minutes at a constant flow rate, and Solution (IV) was added simultaneously with Solution (III) over 15 minutes at a constant flow rate. Subsequently, 2.7 g of Sensitizing Dye (b1), 0.6 g of Sensitizing Dye (b2), 11.2 g of Sensitizing Dye (b3), and 4.7 g of Sensitizing Dye (b4) were added to the mixed solution and stirred at 45° C. for 8 minutes.

After the reaction solution was washed with water by ordinary method and desalted (Precipitant (b) was used, pH was 3.3), 1,500 g of lime-processed ossein gelatin, 13 g of sodium chloride and 4.4 g of Compound (b) were added and pH was adjusted to 6.1. After the temperature was raised to 60° C., 180 g of sodium chloride, 800 mg of Compound (e), 60 mg of sodium thiosulfate, and 134 mg of chloroauric acid were further added and chemical sensitization was performed for 40 minutes, and then 2.7 g of Antifoggant (2) and 134 g of Compound (c) were added in order and the reaction solution was cooled. Thus, 38.4 kg of a monodispersed cubic silver chlorobromide emulsion having an average grain size of 0.30 $\mu$m was obtained.

TABLE 2

| | Solution I | Solution II | Solution III | Solution IV |
|---|---|---|---|---|
| $AgNO_3$ | 3,150 g | — | 3,150 g | — |
| KBr | — | 772 g | — | 1,120 g |

TABLE 2-continued

| | Solution I | Solution II | Solution III | Solution IV |
|---|---|---|---|---|
| NaCl | — | 878 g | — | 602 g |
| Water to make | 14,175 ml | 14,175 ml | 15,120 ml | 15,120 ml |

Sensitizing Dye (b1)

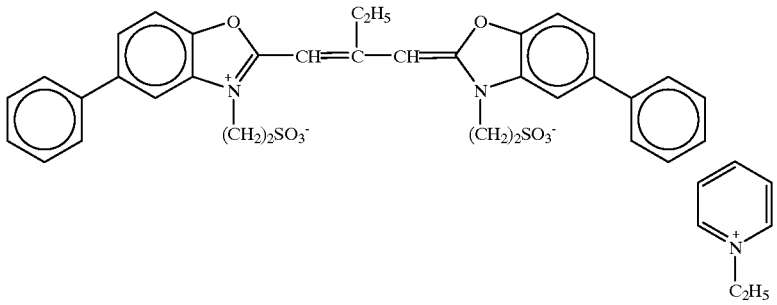

Sensitizing Dye (b2)

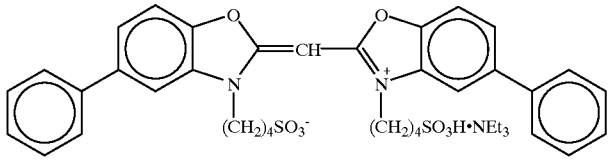

Sensitizing Dye (b3)

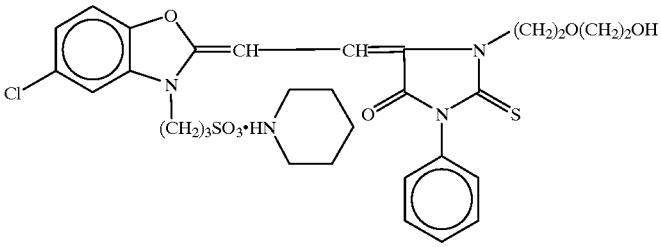

Sensitizing Dye (b4)

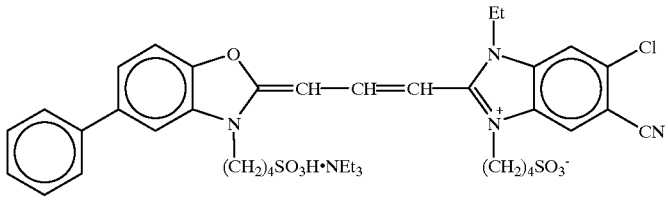

Antifoggant (2)

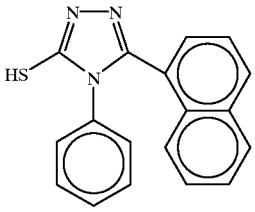

Photosensitive Silver Halide Emulsion (3) (for blue-sensitive emulsion layer)

Solution (I) having the composition shown in Table 3 was added over 30 minutes at a constant flow rate to an aqueous gelatin solution with thoroughly stirring (1,280 g of gelatin, 128 g of sodium chloride, 19.2 g of potassium bromide, 992 ml of sulfuric acid (1N), and 192 ml of a 1% aqueous solution of Compound (a) were added to 34.7 liters of water and the temperature was maintained at 50° C.), and Solution (II) was added simultaneously with Solution (I) over 30 minutes at a constant flow rate. After 5 minutes, Solution (III) having the composition shown in Table 3 was added over 24 minutes at a constant flow rate, and Solution (IV) was added simultaneously with Solution (III) over 25 minutes at a constant flow rate. Subsequently, 10 g of Sensitizing Dye (c1) and 10 g of Sensitizing Dye (c2) were added to the mixed solution and stirred at 50° C. for 15 minutes.

After the reaction solution was washed with water by ordinary method and desalted (Precipitant (a) was used, pH was 3.7), 1,408 g of lime-processed ossein gelatin, 19.2 g of sodium chloride and 4.5 g of Compound (b) were added and pH was adjusted to 7.4. After the temperature was raised to 60° C., 3 g of Sensitizing Dye (c3), 7.9 g of 4-hydroxy-6-methyl-1,3,3a,7-tetraazaindene, 178 mg of trimethylthiourea, and 134 mg of chloroauric acid were added and chemical sensitization was performed for 40 minutes, and again, 7.9 g of 4-hydroxy-6-methyl-1,3,3a,7-tetraazaindene, and 7.9 g of Antifoggant (3) and 198 g of Compound (c) were added in order and the reaction solution was cooled. Thus, 45 kg of a monodispersed cubic silver chlorobromide emulsion having an average grain size of 0.35 μm was obtained.

TABLE 3

| | Solution I | Solution II | Solution III | Solution IV |
|---|---|---|---|---|
| $AgNO_3$ | 1,920 g | — | 4,480 g | — |
| KBr | — | 873 g | — | 2,824 g |
| NaCl | — | 231 g | — | 155 g |
| Water to make | 11,520 ml | 11,584 ml | 15,936 ml | 16,384 ml |

Precipitant (a)

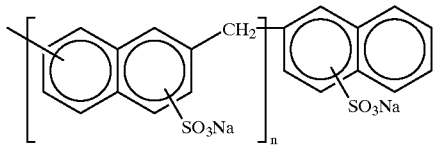

Sensitizing Dye (c1)

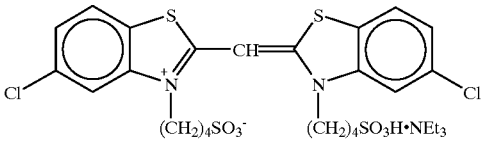

TABLE 3-continued

| | Solution I | Solution II | Solution III | Solution IV |
|---|---|---|---|---|

Antifoggant (3)

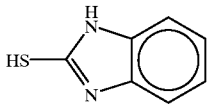

Sensitizing Dye (c2)

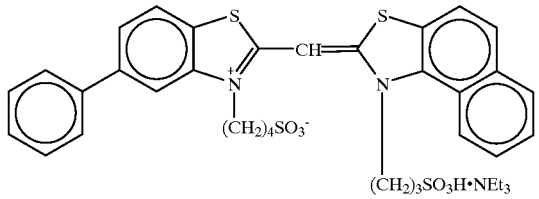

Sensitizing Dye (c3)

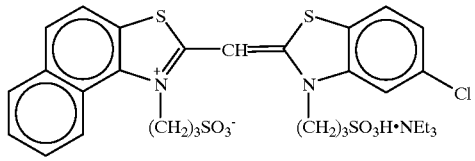

The producing method of a zinc hydroxide dispersion is described below.

Twelve point five (12.5) grams of zinc hydroxide having an average particle size of 0.2 μm, 1 g of carboxymethyl cellulose as a dispersant, and 0.1 g of sodium polyacrylate were added to 100 ml of a 4% aqueous gelatin solution, and the mixture was pulverized in a mill with glass beads having an average diameter of 0.75 mm for 30 minutes. Glass beads were removed, thereby a zinc hydroxide dispersion was obtained.

The producing method of a gelatin dispersion of hydrophobic additives is described below.

Dispersions of a yellow dye-providing compound, a magenta dye-providing compound, and a cyan dye-providing compound were respectively prepared according to the prescriptions shown in Table 4. That is, each oil phase component was dissolved by heating at about 70° C. to make a homogeneous solution, each water phase component heated at about 60° C. was added to the above homogeneous solution, the solution was stirred and mixed, and then dispersed with a homogenizer at 10,000 rpm for 10 minutes. Water was added to the above dispersion and stirred to thereby obtain a homogeneous dispersion.

TABLE 4

| Composition of Dispersion | Yellow | Magenta | Cyan |
|---|---|---|---|
| Cyan dye-providing compound (1) | — | — | 183.1 g |
| Cyan dye-providing compound (2) | — | — | 274.3 g |
| Magenta dye-providing compound (1) | — | 139.33 g | — |
| Magenta dye-providing compound (2) | — | 339.87 g | — |
| Yellow dye-providing compound (1) | 558.0 g | — | — |
| Compound (h) | 26.8 g | 5.4 g | 26.2 g |
| Compound (d) | 69.8 g | — | — |
| Compound (q) | — | 3.3 g | — |
| Compound (m) | — | 5.4 g | — |
| Surfactant (1) | 26.3 g | 10.0 g | 19.6 g |
| Compound (p) | 39.9 g | 20.5 g | 38.0 g |
| Compound (o) | — | 20.5 g | — |
| High boiling point solvent (2) | 279.0 g | 239.6 g | 77.4 g |
| High boiling point solvent (1) | — | — | 179.7 g |
| Compound (i) | — | — | 54.5 g |
| Water | — | — | 27.2 ml |
| Ethyl acetate | 1,457.4 ml | 779 ml | 653.4 ml |
| Lime-processed gelatin | 311.8 g | 262.4 g | 261.4 g |
| Zinc nitrate | — | 11.2 g | — |
| Water | 4,717.2 ml | 3,887.6 ml | 3,703.5 ml |
| Water added | 3,047.6 ml | 4,496.9 ml | 5,457.4 ml |
| Compound (b) | 1.4 g | 1.1 g | 1.1 g |

Dyestuff (A)

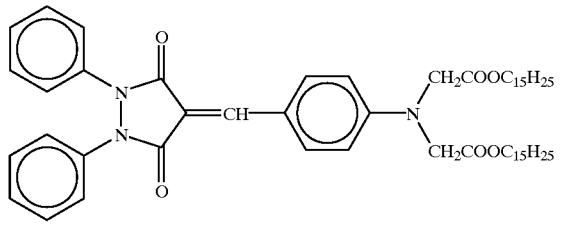

Compound (d)

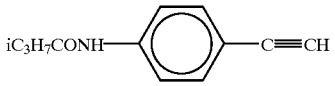

Compound (n)

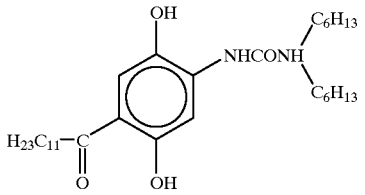

High Boiling Point Organic Solvent (1)

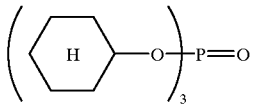

Compound (f)

$C_{26}H_{48.9}Cl_{7.1}$

Compound (g)

TABLE 4-continued
| Composition of Dispersion | | |
|---|---|---|
| Yellow | Magenta | Cyan |
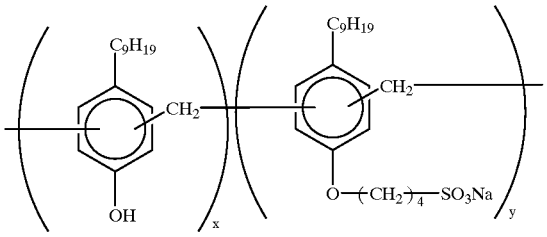
x/y ≈ 58/42
Surfactant (1)
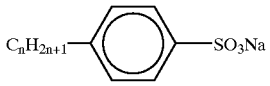
n ≈ 12.6
Compound (h)
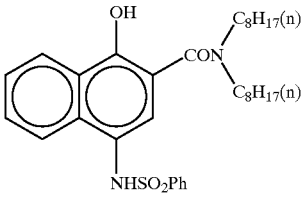
Cyan Dye-Donating Compound (1)
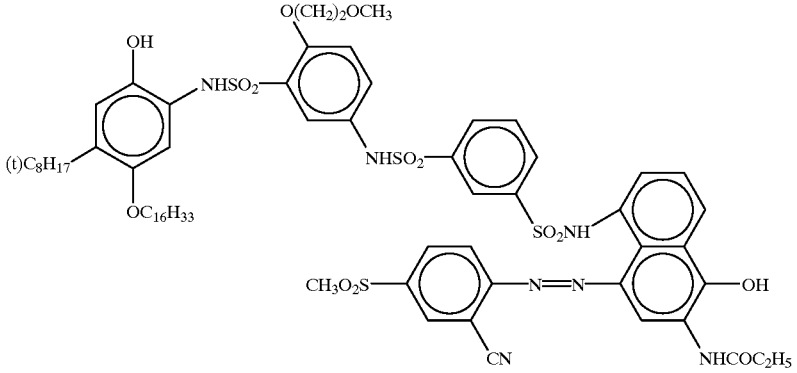
Cyan Dye-Donating Compound (2)
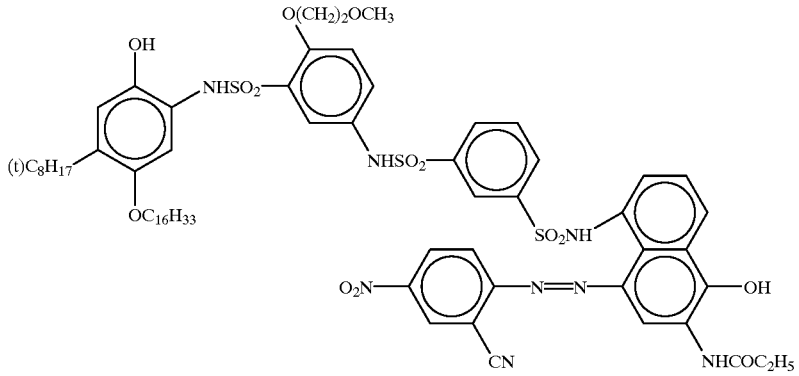
Compound (h)

TABLE 4-continued
| Composition of Dispersion | | |
|---|---|---|
| Yellow | Magenta | Cyan |
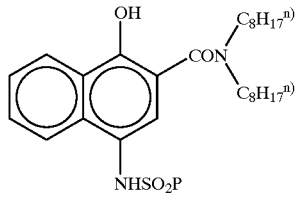
Compound (o)
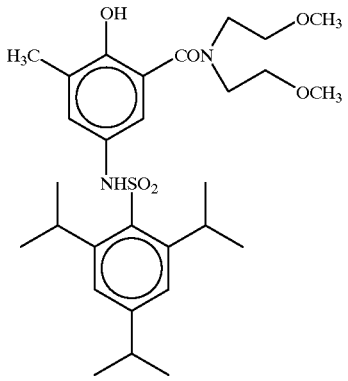
Compound (i)
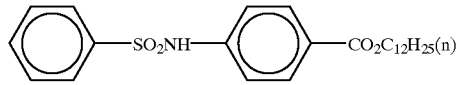
High Boiling Point Organic Solvent (2)
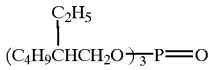
Compound (p)
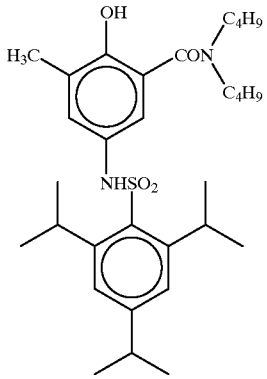
Compound (q)
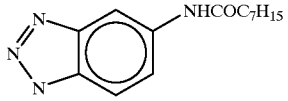
Magenta Dye-Donating Compound (1)

TABLE 4-continued
| | Composition of Dispersion | | |
|---|---|---|---|
| | Yellow | Magenta | Cyan |
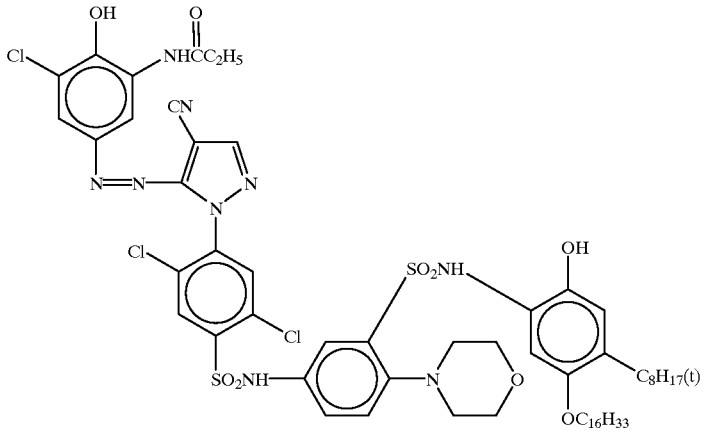
Magenta Dye-Donating Compound (2)
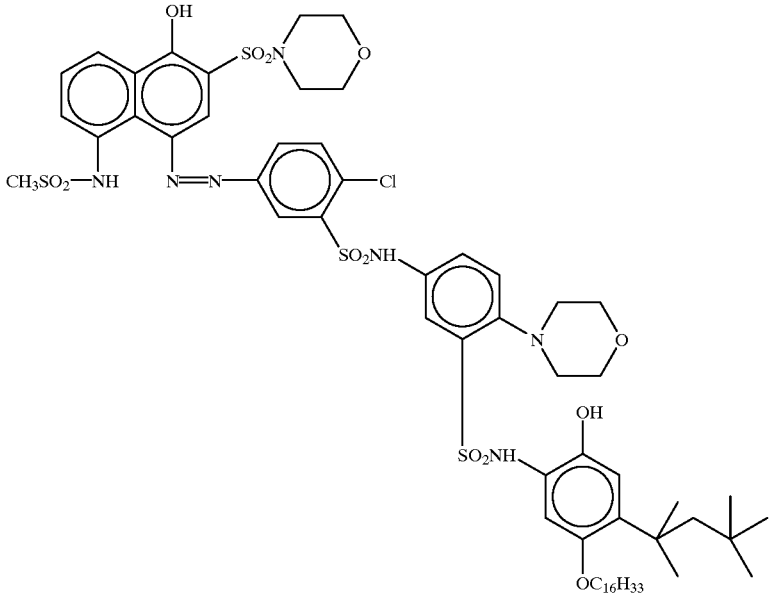
Compound (m)
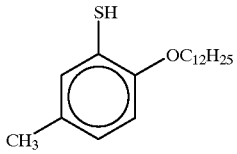
Yellow Dye-Donating Compound (1)

TABLE 4-continued

| Composition of Dispersion | Yellow | Magenta | Cyan |
|---|---|---|---|
| 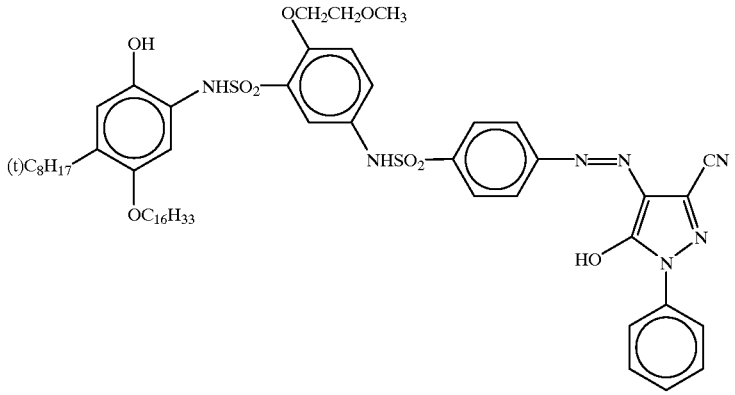 | | | |

Gelatin dispersions of Compound (d), and Compound (d) and Dyestuff (A) were prepared were respectively prepared according to the prescriptions shown in Table 5. That is, each oil phase component was dissolved by heating at about 60° C. to make a homogeneous solution, each water phase component heated at about 60° C. was added to the above homogeneous solution, the solution was stirred and mixed, and then dispersed with a homogenizer at 10,000 rpm for 10 minutes. Water was added to the above dispersion and stirred to thereby obtain a homogeneous dispersion.

TABLE 5

| Composition of Dispersion | Antifoggant | Dye |
|---|---|---|
| Compound (d) | 76.8 g | 38.4 g |
| Dyestuff (A) | — | 406.6 g |
| Compound (h) | 10.1 g | 10.1 g |
| Compound (n) | — | 226.40 g |
| Compound (f) | 23.24 g | 23.24 g |
| High boiling point solvent (1) | 229.2 g | 229.2 g |
| Surfactant (1) | 48.0 g | 48.0 g |
| Compound (g) | 47.5 g | 47.5 g |
| Ethyl acetate | 1,010.2 ml | 1,010.2 ml |
| Lime-processed gelatin | 1,010.2 g | 1,010.2 g |
| Water | 5,303.8 ml | 5,303.8 ml |
| Water added | 2,830.0 ml | 2,235.4 ml |
| Compound (b) | 4.4 g | 4.4 g |

Photographic Material 101 was prepared by coating the coating solutions on a support. The layer constitution and the amount of each component are shown in Table 6.

TABLE 6

| Main Constitutional Elements of Photographic Material No. 101 | Coating Amount (ml/m$^2$) |
|---|---|
| Seventh Layer (protective layer) | |
| Acid-Processed Gelatin | 335 |
| Matting Agent | 19 |
| Surfactant (2) | 4.9 |

TABLE 6-continued

| Main Constitutional Elements of Photographic Material No. 101 | Coating Amount (ml/m$^2$) |
|---|---|
| Surfactant (4) | 130 |
| Surfactant (3) | 65 |
| Calcium Nitrate | 4.6 |
| Sixth Layer (interlayer) | |
| Lime-Processed Gelatin | 510 |
| Compound (d) | 22 |
| Compound (h) | 3.0 |
| High Boiling Point Organic Solvent (1) | 67 |
| Compound (f) | 6.8 |
| Compound (g) | 14 |
| Surfactant (1) | 14 |
| Calcium Nitrate | 8.2 |
| Water-Soluble Polymer (1) | 6.1 |
| Fifth Layer (blue-sensitive layer) | |
| Lime-Processed Gelatin | 403 |
| Photosensitive Silver Halide Emulsion | as silver 351 |
| Yellow Dye-Donating Compound (1) | 318 |
| Compound (d) | 40 |
| Compound (h) | 15 |
| High Boiling Point Organic Solvent (2) | 16 |
| Compound (p) | 30 |
| Surfactant (1) | 15 |
| Fourth Layer (interlayer) | |
| Lime-Processed Gelatin | 450 |
| Compound (d) | 11 |
| Dyestuff (A) | 106 |
| Compound (h) | 2.8 |
| Compound (n) | 64 |
| High Boiling Point Organic Solvent (1) | 64 |
| Compound (f) | 6.5 |
| Zinc Hydroxide | 340 |
| Compound (g) | 13 |
| Surfactant (1) | 13 |
| Surfactant (4) | 21 |
| Surfactant (3) | 1.0 |
| Calcium Nitrate | 7.0 |
| Potassium Bromide | 3.5 |
| Water-Soluble Polymer (1) | 31 |

The producing method of an image-receiving material is described below.

Image-Receiving Mateiral 201 having the constitution as shown in Tables 7 and 8 was prepared.

Mordant (2) is a reactant of Mordant (1) and Discoloration Inhibitor (1). Mordant (2) was produced by adding 0.4 mol % of a powder of Discoloration Inhibotor (1) to a 25% aqueous solution of Mordant (1) and stirred at 60% for 3 hours.

TABLE 6

(cont'd)

| | | Coating Amount ($ml/m^2$) |
|---|---|---|
| Third Layer (green-sensitive layer) | | |
| Lime-Processed Gelatin | | 444 |
| Photosensitive Silver Halide Emulsion | as silver | 462 |
| Magenta Dye-Donating Compound (1) | | 120 |
| Magenta Dye-Donating Compound (2) | | 293 |
| Compound (q) | | 2.6 |
| Compound (m) | | 4.3 |
| Zinc Nitrate | | 8.9 |
| Compound (h) | | 4.3 |
| High Boiling Point Organic Solvent (2) | | 190 |
| Compound (p) | | 16 |
| Compound (o) | | 16 |
| Surfactant (1) | | 8.6 |
| Water-Soluble Polymer (1) | | 17 |
| Second Layer (interlayer) | | |
| Lime-Processed Gelatin | | 587 |
| Compound (d) | | 18 |
| Dyestuff (A) | | 173 |
| Compound (h) | | 4.6 |
| Compound (n) | | 104 |
| High Boiling Point Organic Solvent (1) | | 105 |
| Compound (f) | | 11 |
| Zinc Hydroxide | | 555 |
| Compound (g) | | 22 |
| Surfactant (1) | | 22 |
| Surfactant (4) | | 34 |
| Surfactant (3) | | 1.5 |
| Calcium Nitrate | | 11 |
| Potassium Bromide | | 5.7 |
| Water-Soluble Polymer (1) | | 50 |
| First Layer (red-sensitive layer) | | |
| Lime-Processed Gelatin | | 353 |
| Photosensitive Silver Halide Emulsion | as silver | 179 |
| Cyan Dye-Donating Compound (1) | | 123 |
| Cyan Dye-Donating Compound (2) | | 184 |
| Stabilizer | | 4.1 |
| Compound (h) | | 18 |
| High Boiling Point Organic Solvent (1) | | 121 |
| High Boiling Point Organic Solvent (2) | | 52 |
| Compound (i) | | 37 |
| Compound (p) | | 26 |
| Surfactant (1) | | 13 |
| Water-Soluble Polymer (1) | | 7.4 |
| Hardening Agent (1) | | 35 |

Support

Polyethylene laminated paper support, thickness: 131 pm

Surfactant (2)

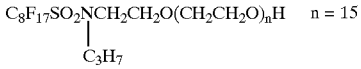

$C_8F_{17}SO_2N(C_3H_7)CH_2CH_2O(CH_2CH_2O)_nH$ n = 15

Surfactant (3)

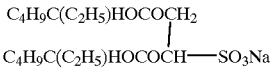

$C_4H_9C(C_2H_5)HOCOCH_2$
$C_4H_9C(C_2H_5)HOCOCH—SO_3Na$

Surfactant (4)

TABLE 6-continued (cont'd)

| | Coating Amount ($ml/m^2$) |
|---|---|

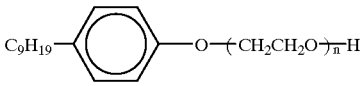

$C_9H_{19}$—O—$(CH_2CH_2O)_n$H n =20

Water-soluble Polymer (1).

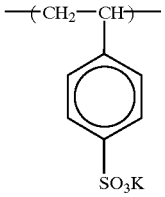

Hardening Agent (1)

$CH_2{=}CHSO_2CH_2SO_2CH{=}CH_2$

Stabilizer

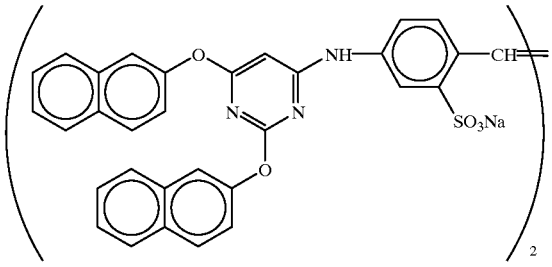

TABLE 7

Constitution of Image-Receiving Material R201

| | Coating Amount ($mg/m^2$) |
|---|---|
| Sixth Layer | |
| Water-soluble polymer (5) | 130 |
| Water-soluble polymer (2) | 35 |
| Water-soluble polymer (3) | 45 |
| Potassium Nitrate | 20 |
| Anionic Surfactant (1) | 6 |
| Anionic Surfactant (2) | 6 |
| Ampholytic Surfactant (1) | 50 |
| Antistaining Agent (1) | 7 |
| Antistaining Agent (2) | 12 |
| Matting Agent (1) | 7 |
| Fifth Layer | |
| Gelatin | 250 |
| Water-Soluble Polymer (5) | 25 |
| Anionic Surfactant (3) | 9 |
| Hardening Agent (2) | 185 |
| Fourth Layer | |
| Mordant (2) | 1,850 |
| Water-Soluble Polymer (2) | 260 |
| Water-Soluble Polymer (4) | 1,400 |
| Latex Dispersion (1) | 600 |
| Anionic Surfactant (2) | 25 |
| Nonionic Surfactant (1) | 18 |
| Guanidine Picolinate | 2,550 |
| Sodium Quinilinate | 350 |

TABLE 7-continued

| Constitution of Image-Receiving Material R201 | Coating Amount ($mg/m^2$) |
|---|---|
| Third Layer | |
| Gelatin | 370 |
| Mordant (1) | 300 |
| Anionic Surfactant (3) | 12 |
| Second Layer | |
| Gelatin | 700 |
| Mordant (1) | 290 |
| Water-Soluble Polymer (5) | 55 |
| Water-Soluble Polymer (2) | 330 |
| Anionic Surfactant (3) | 30 |
| Anionic Surfactant (4) | 7 |
| High Boiling Point Organic Solvent (3) | 700 |
| Brightening Agent (1) | 30 |
| Antistaining Agent (3) | 32 |
| Guanidine Picolinate | 360 |
| Sodium Quinilinate | 45 |
| First Layer | |
| Gelatin | 280 |
| Water-Soluble Polymer (5) | 12 |
| Anionic Surfactant (1) | 14 |
| Sodium Metaborate | 35 |
| Hardening Agent (2) | 185 |

Support

Polyethylene laminated paper support, thickness: 215 μm

The coating amount of latex dispersion is a coating amount of latex solid content.

Anionic Surfactant (1)

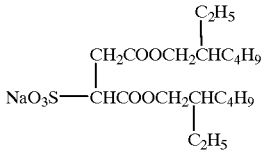

Anionic Surfactant (2)

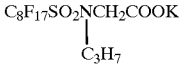

Anionic Surfactant (3)

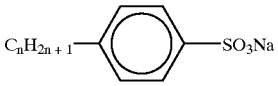

n = 12.6

Anionic Surfactant (4)

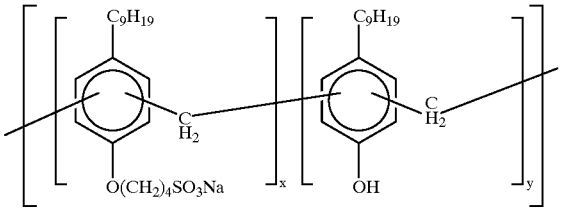

x:y = 4:6
m = 6.8

Nonionic Surfactant (1)

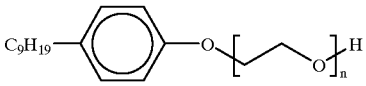

n = 85

-continued

Discoloration Inhibitor (1)

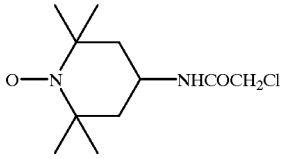

Ampholytic Surfactant (1)

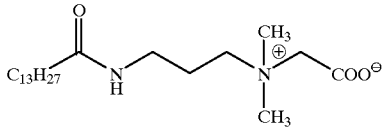

Brightening Agent (1)

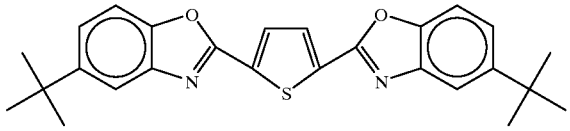

Mordant (1)

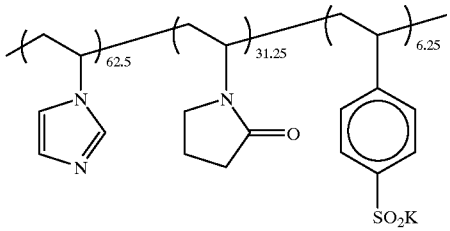

Antistaining Agent (1)

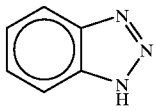

Antistaining Agent (2)

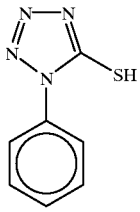

Antistaining Agent (3)

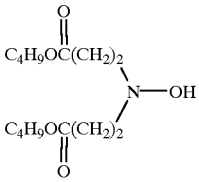

High Boiling Point Organic Solvent (3)]

$C_{26}H_{46.9}Cl_{7.1}$ $Empara_{40}$ (a product of by Ajinomoto Co., Ltd.)

Water-Soluble Polymer (5)

Sumikagel L-5H (a product of Sumitomo Chemical Co., Ltd.)

Water-Soluble Polymer (2)

Dextran (molecular weight: 70,000)

Water-Soluble Polymer (3)

Copper carrageenan (a product of Taito Co., Ltd.)

Water-Soluble Polymer (4)

MP Polymer PM-102 (a product of Kuraray Co., Ltd.)

Latex Dispersion (1)

LX-438 (a product of Nippon Zeon Co., Ltd.)

Matting Agent (1)

SYLOID 79 (a product of Fuji Davison Co., Ltd.)

Hardening Agent (2)

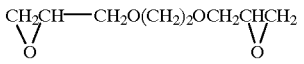

TABLE 8

Constitution of Support (2)

| Layer Name | Composition | | Film Thickness (μm) |
|---|---|---|---|
| Surface Undercoat Layer | Gelatin | | 0.1 |
| Surface PE Layer (glossy) | Low molecular weight polyethylene (density: 0.923): | 90.2 parts | 36.0 |
| | Surface-treated titanium oxide: | 9.8 parts | |
| | Ultramarine: | 0.001 parts | |
| Pulp Layer | High quality paper (LBKP/NBSP = 6/4, density: 1.053) | | 152.0 |
| Back PE Layer (mat) | High density polyethylene (density: 0.955) | | 27.0 |
| Back Undercoat Layer | Alumina sol: | 9.8 parts | 0.7 |
| | Colloidal silica: | 5.1 parts | |
| | PVA (molecular weight: 200) : | 85.1 parts | |
| | Total | | 215.8 |

Producing Method of Photosensitive Silver Halide Emulsion (4) (for red-sensltive emulsion layer)

A monodispersed cubic silver chlorobromide emulsion was prepared in the same manner as the preparation of Silver Halide Emulsion (1) except that 0.3 g of $K_4[Fe(CN)_6].3H_2O$ (0.19 eV) and 2 mg of $K_2IrCl_6$ (0.42 eV) were added to Solution IV in Table 1.

Producing Method of Photosensitive Silver Halide Emulsion (5) (for green-sensitive emulsion layer)

A monodispersed cubic silver chlorobromide emulsion was prepared in the same manner as the preparation of Silver Halide Emulsion (2) except that 0.6 g of $K_4[Fe(CN)_6].3H_2O$ was added to Solution IV in Table 1.

Producing Method of Photosensitive Silver Halide Emulsion (6) (for blue-sensitive emulsion layer)

A monodispersed cubic silver chlorobromide emulsion was prepared in the same manner as the preparation of Silver Halide Emulsion (2) except that 2.6 g of $K_4[Fe(CN)_6].3H_2O$ was added to Solution IV in Table 1.

Photographic Material 102 was prepared in the same manner as the preparation of Photographic Material 101 except that Photosensitive Silver Halide Emulsions (1), (2) and (3) were replaced with Silver Halide Emulsions (4), (5) and (6) according to the present invention.

Producing Method of Photosensitive Silver Halide Emulsion (7) (for red-sensitive emulsion layer)

A monodispersed cubic silver chlorobromide emulsion was prepared in the same manner as the preparation of Silver Halide Emulsion (1) except that 2 mg of $(NH)_4RhCl_6$ (0.5 eV) was added to Solution II in Table 1 and 0.3 g of $K_4[Fe(CN)_6].3H_2O$ was added to Solution IV in Table 1.

Producing Method of Photosensitive Silver Halide Emulsion (8) (for green-sensitive emulsion layer)

A monodispersed cubic silver chlorobromide emulsion was prepared in the same manner as the preparation of Silver Halide Emulsion (2) except that 1.5 mg of $(NH)_4RhCl_6$ was added to Solution II in Table 2 and 0.56 g of $K_4[Fe(CN)_6].3H_2O$ was added to Solution IV.

Producing Method of Photosensitive Silver Halide Emulsion (9) (for blue-sensitive emulsion layer)

A monodispersed cubic silver chlorobromide emulsion was prepared in the same manner as the preparation of Silver Halide Emulsion (3) except that 1.0 mg of $(NH)_4RhCl_6$ was added to Solution II in Table 3 and 2.6 g of $K_4[Fe(CN)_6].3H_2O$ was added to Solution IV. Photographic Material 103 was prepared in the same manner as the preparation of Photographic Material 101 except that Photosensitive Silver Halide Emulsions (1), (2) and (3) were replaced with Silver Halide Emulsions (7), (8) and (9) according to the present invention.

Producing Method of Comparative Photoaraphic Material

Silver Halide Emulsions (10), (11) and (12) were prepared in the same manner as the preparation of Photosensitive Silver Halide Emulsions (1), (2) and (3) respectively except that the sensitizing dyes in Photosensitive Silver Halide Emulsions (1), (2) and (3) were respectively replaced with Sensitizing Dye (a1) alone, (b1) alone and (c1) alone. Photographic Material 104 was prepared in the same manner as the preparation of Photographic Material 101 except that Photosensitive Silver Halide Emulsions (1), (2) and (3) were replaced with Silver Halide Emulsions (10), (11) and (12).

Five in each LED of blue, green and red were used in an LED exposure unit. The wavelengths of center of gravity were 455 nm, 458 nm, 462 nm, 465 nm, and 468 nm as blue LED, 534 nm, 538 nm, 541 nm, 546 nm, and 550 nm as green LED, and 650 nm, 654 nm, 658 nm, 662 nm, and 665 nm as red LED.

The exposure unit was a scanning exposure unit with a scanning speed of 800 mm/sec in the main scanning direction and 2 mm/sec in the secondary scanning direction.

The above produced Photographic Materials 101 to 104 were subjected to the following exposure and processing.

Electrical setting was performed in advance using the above LED exposure unit in a manner that only blue LED of 455 nm, green LED of 534 nm and red LED of 650 nm were emitted so that the density of corresponding yellow, magenta and cyan respectively became 0.7. Remaining four LED of each color were electrically set so that the quantity of light became the same.

Using this LED scanning head, electric signals were given to each LED which underwent electrical setting and scanning exposure was conducted on a photographic material. Exposure pattern was one-way exposure. Subsequently, a fountain solution was supplied on the emulsion surface of the exposed photographic material by a wire bar, and then the photographic material was superposed on Image-Receiving Material R201 so that the layer surface might be touched with Image-Receiving Material R201. After heating at development temperature of 83° C. for 20 seconds, the image-receiving material was peeled off from the photographic material, thereby an image of 300 DIP was obtained on the image-receiving material.

Unevenness of density of the obtained gray image was examined. Streak unevenness of a pitch of about 85 μm due to the density unevenness was visually observed on the image outputted from Photographic Material 104 but density unevenness was hardly observed on the image outputted from Photographic Materials 102 to 103 according to the present invention.

Subsequently, density unevenness was examined using a microdensitometer (measurement beam diameter: 10 μm) and fluctuation in sensitivity due to LED wavelength fluctuation was examined. The value of the largest sensitivity fluctuation to the wavelength fluctuation of each LED is shown in Table 9. It can be seen that density unevenness does not occur at 0.01 logE/nm or less.

TABLE 9

| Photographic Material | Visual Observation of Unevenness | B (logE/nm) | G (logE/nm) | R (logE/nm) |
|---|---|---|---|---|
| 101 (Comparison) | Generated a little. | 0.008 | 0.012 | 0.006 |
| 102 (Invention) | Not generated. | 0.008 | 0.008 | 0.006 |
| 103 (Invention) | Not generated. | 0.006 | 0.008 | 0.006 |
| 104 (Comparison) | Generated. | 0.016 | 0.018 | 0.016 |

Exposure was then performed by reciprocating writing for shortening the entire exposure time, i.e., performing exposure also on the way back of the exposure head, and 300 DPI image was obtained on the image-receiving material in the same manner as described above.

Unevenness of density of the obtained gray image was examined. The results obtained are shown in Table 10. Streak unevenness of a pitch of about 85 μm due to the density unevenness was visually observed on the image outputted from Photographic materials 101 and 104 but density unevenness was hardly observed on the image outputted from Photographic Materials 102 to 103 according to the present invention. It can be understood from the results that reciprocating writing unevenness resulting from multi-exposure using a plurality of light sources could be improved by incorporating a metal ion or a metal complex ion which is shallow electron trap or a metal ion or a metal complex ion having relatively deep electron traps into a silver halide grain.

TABLE 10

| | B | | G | | R | |
|---|---|---|---|---|---|---|
| Photographic Material | Visual Observation of Unevenness | Kind of Dope | Visual Observation of Unevenness | Kind of Dope | Visual Observation of Unevenness | Kind of Dope |
| 101 (Comparison) | Generated | — | Generated | — | Generated | — |
| 102 (Invention) | Not generated | Fe | Generated a little | Fe | Not generated | Fe Ir |
| 103 (Invention) | Not generated | Fe Rh | Not generated | Fe Rh | Not generated | Fe Rh |
| 104 (Comparison) | Generated | — | Generated | — | Generated | — |

EFFECT OF THE INVENTION

According to the present invention, in a method of forming an image by exposing a photographic material with at least one exposure head having a plurality of light sources, exposure density unevenness, in particular, generation of density unevenness by reciprocating writing for shortening the entire exposure time can be conspicuously improved.

While the invention has been described in detail and with reference to specific examples thereof, it will be apparent to one skilled in the art that various changes and modifications can be made therein without departing from the spirit and scope thereof.

What is claimed is:

1. An image-forming method which comprises exposing a photographic material comprising a support having thereon at least a photosensitive silver halide emulsion and a binder, the silver halide emulsion containing at least one compound selected from metal ions and metal complex ions which are electron traps of 0.2 eV or less in depth, with an exposing head having at least three exposure light sources having different specific light emitting wavelength regions corresponding to at least three different color sensitivities of the photographic material, each of the at least three exposure light sources having different center-of-gravity wavelengths in each of the specific light emitting wavelength regions, wherein each of the specific light emitting wavelength regions is from the shortest wavelength to the longest wavelength among the exposure light sources having different center-of-gravity wavelengths, and the photographic material has a sensitivity variation of 0.01 logE/nm or less in each of the specific wavelength light emitting wavelength regions, and wherein the exposing head performs reciprocating writing which is scanning exposure not only in one direction but on the way back.

2. The image-forming method as claimed in claim 1, wherein the silver halide emulsion contains at least one compound selected from metal ions and metal complex ions which are electron traps of 0.2 eV or less in depth, and at least one compound selected from metal ions and metal complex ions which are electron traps of 0.35 eV or more in depth.

3. The image-forming method as claimed in claim 1, wherein the photographic material is a heat-developable photographic material comprising a support having thereon at least three silver halide emulsions each having different color sensitivity, a binder, and a dye-providing compound.

4. The image-forming method as claimed in claim 1, wherein the at least three exposure light sources are LEDs having light emitting wavelengths of from visible region to infrared region.

5. The image-forming method as claimed in claim 1, wherein the at least three exposure light sources are blue LEDs, green LEDs and red LEDs.

* * * * *